US010028072B2

(12) United States Patent
Thakur et al.

(10) Patent No.: US 10,028,072 B2
(45) Date of Patent: Jul. 17, 2018

(54) AUDIO SYSTEM AND METHOD

(71) Applicant: Facebook, Inc., Menlo Park, CA (US)

(72) Inventors: Abesh Thakur, Edinburgh (GB); Ross Taylor, Edinburgh (GB); Tobias Graham Fone Carpenter, Edinburgh (GB); Varun Nair, Edinburgh (GB)

(73) Assignee: Facebook, Inc., Menlo Park, CA (US)

( * ) Notice: Subject to any disclaimer, the term of this patent is extended or adjusted under 35 U.S.C. 154(b) by 0 days.

(21) Appl. No.: 15/232,402

(22) Filed: Aug. 9, 2016

(65) Prior Publication Data

US 2017/0208417 A1 Jul. 20, 2017

(30) Foreign Application Priority Data

Jan. 19, 2016 (GB) ..... 1601000.1

(51) Int. Cl.
*H04R 5/02* (2006.01)
*H04S 7/00* (2006.01)

(52) U.S. Cl.
CPC ..... *H04S 7/306* (2013.01); *H04S 7/303* (2013.01); *H04S 2400/11* (2013.01); *H04S 2420/01* (2013.01)

(58) Field of Classification Search
CPC ... H04S 7/00; H04S 7/40; H04S 7/302; H04S 7/303; H04S 7/305; H04S 7/306; H04S 7/30; H04S 2420/01; H04S 2420/03; H04S 2400/11; H04S 2400/15; H04S 1/007; G06F 3/012; H04R 3/00; H04R 5/00; H04R 5/02
See application file for complete search history.

(56) References Cited

U.S. PATENT DOCUMENTS 6,973,192 B1 12/2005 Gerrard et al.
2004/0111171 A1* 6/2004 Jang ..... H04S 7/30 700/94
2005/0182608 A1 8/2005 Jahnke
2013/0114819 A1* 5/2013 Melchior ..... H04S 7/30 381/59
2014/0185810 A1* 7/2014 Lee ..... H04H 40/36 381/2
2015/0294041 A1* 10/2015 Yeh ..... G06F 17/5009 703/2
2015/0378019 A1 12/2015 Schissler et al.
2016/0034248 A1* 2/2016 Schissler ..... G06F 3/165 381/17

OTHER PUBLICATIONS

Brown, C. et al., "A Structural Model for Binaural Sound Synthesis," IEEE Transaction on Speech and Audio Processing, vol. 6, No. 5, Sep. 1998, pp. 476-488.

(Continued)

*Primary Examiner* — Thang Tran
(74) *Attorney, Agent, or Firm* — Fenwick & West LLP

(57) ABSTRACT

Embodiments relate to, for a scene comprising a representation of at least one object and at least one sound source: obtaining a decomposition of the at least one object, the decomposition comprising at least one geometric component; modelling at least one interaction of the at least one object and the at least one sound source using the at least one geometric component; and, in dependence on the modelling of the at least one interaction, processing an audio input associated with the at least one sound source to obtain an audio output.

31 Claims, 11 Drawing Sheets

(56) References Cited

OTHER PUBLICATIONS

Chan, C. etr al., "A Minimum Bounding Box Algorithm and its Application to Rapid Prototyping," The University of Texas in Austin SFF Symposium Proceeding, Aug. 1999, pp. 163-170.
Collins, A. "FIR Filter Design," Date Unknown, three pages. [Online] [Retrieved Nov. 17, 2016] Retrieved from the internet <http://www.arc.id.au/FilterDesign.html>.
Mamou, K. et al., "A Simple and Efficient Approach for 3D Mesh Approximate Convex Decomposition," International Conference on Image Processing, Nov. 2009, pp. 3501-3504.
Mamou, K., "HACD: Hierarchical Approximate Convex Decomposition," Oct. 2, 2011, seven pages. [Online] [Retrieved Sep. 16, 2015] Retrieved from the internet <http://kmamou.blogspot.co.uk/2011/10/hacd-hierarchical-approximate-convex.html>.
Savioja, L. et al., "Creating Interactive Virtual Acoustic Environments," J. Audio Eng. Soc., vol. 47, No. 9, Sep. 1999, pp. 675-705.
Schissler, C. et al., "GSound: Interactive Sound Propagation for Games," Proc. of AES 41st Conference: Audio for Games, 2011, six pages.
United Kingdom Intellectual Property Office, Combined Search and Examination Report under Sections 17 & 18(3), UK Patent Application No. GB 1601000.1, dated Mar. 28, 2017, six pages.

* cited by examiner

AUDIO SYSTEM AND METHOD

CROSS-REFERENCE TO RELATED APPLICATION

This application claims priority under 35 U.S.C. § 119(a) to United Kingdom Patent Application No. 1601000.1 filed on Jan. 19, 2016, which is incorporated by reference herein in its entirety.

BACKGROUND

The present invention relates to an audio system and method, for example an audio system and method for obtaining an audio output for a scene comprising at least one object and at least one sound source.

It is known that a computer game or other interactive application may be made up of multiple computer-generated objects in a computer-generated scene. The objects may be represented in 3D. For example, objects may be represented as polygonal meshes, which may also be referred to as a wire-frame representation.

A scene may also contain multiple sound sources. A given sound source may be associated with an object in the scene, or may be independent of the objects in the scene. Sound associated with a given sound source may comprise, for example, recorded sound and/or computer-generated sound.

A scene may further contain a position with respect to which sound is determined. The position with respect to which sound is determined may be referred to as the position of a listener. The position of the listener may be used to determine what a user (for example, a player of the game) hears.

The position of the listener may be attached to a virtual camera position. If the position of the listener is attached to a virtual camera position, the position from which the user sees the scene may be the same as the position from which the user hears sounds associated with the scene. However, while the user may only be able to see objects that are in front of the virtual camera, in some circumstances the user may be able to hear sound sources at any angle relative to the listener, including sound sources behind the listener.

3D audio may refer to a technique used to process audio in such a way that a sound may be positioned anywhere in 3D space. The positioning of sounds in 3D space may give a user the effect of being able to hear a sound over a pair of headphones, or from another source, as if it came from any direction (for example, above, below or behind). The positioning of sound in 3D space may be referred to as spatialisation. 3D audio may be used in applications such as games, virtual reality or augmented reality to enhance the realism of computer-generated sound effects supplied to the user.

One method of obtaining 3D audio may be binaural synthesis. Binaural synthesis may aim to process monaural sound (a single channel of sound) into binaural sound (a plurality of channels, for instance at least one channel for each ear, for example a channel for each headphone of a set of headphones) such that it appears to a listener that sounds originate from sources at different positions relative to the listener, including sounds above, below and behind the listener.

For example, binaural synthesis may be used to synthesise sound to be delivered to a pair of headphones, in which different signals are sent to the left and right ears of a user. To the user, a difference between the signal received through the user's left ear and the signal received by the user's right ear (for example, a relative time delay) may make it seem that the sound is coming from a particular position. The use of binaural synthesis to obtain audio signals for two headphones or other devices may be described as binaural rendering.

Effects of a user's body on sound received by the user may be simulated. For example, HRTF (head related transfer function) methods may be used to simulate the effect of a listener's head, pinnae and shoulders on sound received from a particular direction.

Various forms of spatialisation may be used. For example, audio signals may be processed to produce spatialisation over speakers or over surround sound, for example over a 5.1 surround sound system. The audio signals may be processed so that a user listening to the signals over speakers or over surround sound perceives the sound as coming from a particular position.

There exist systems in which sound propagation is calculated by ray tracing. See, for example, Carl Schissler and Dinesh Manocha, *GSound: Interactive Sound Propagation for Games*, AES 41$^{st}$ Conference: Audio for Games, 2011.

SUMMARY

In a first aspect of the invention, there is provided a method comprising, for a scene comprising a representation of at least one object and at least one sound source: obtaining a decomposition of the at least one object, the decomposition comprising at least one geometric component; modelling at least one interaction of the at least one object and the at least one sound source using the at least one geometric component; and, in dependence on the modelling of the at least one interaction, processing an audio input associated with the at least one sound source to obtain an audio output.

By modelling interactions of objects and sound sources, an audio output may be obtained that is experienced by a user as being more realistic than an output in which such interactions are not modelled. Using a decomposition of objects may provide a method that is computationally efficient and/or accurate.

A calculation of interactions that is based on a full representation of object geometry (without decomposition into geometrical components) may be complicated and/or CPU intensive. The decomposition into geometric components may allow the calculation of interactions to be less complicated and/or less CPU intensive. Breaking down each object into smaller parts (the geometric components) may allow calculations to be performed on smaller regions than if the original object representation was used.

The audio input may comprise a monaural audio input. The processing may comprise performing binaural synthesis. The audio output may comprise binaural audio output.

In some circumstances, synthesis, for example binaural synthesis, may be computationally intensive. The method of modelling interactions using geometric components may allow such interactions to be added to the synthesis process without an excessive increase in computational load. In some applications, the computational resources used for calculating sound may be limited, and it may be particularly important that sound is processed efficiently.

Each geometric component may comprise a representation of a shape for example a three-dimensional shape. The shape may comprise a simplified representation of the corresponding object or at least part of the corresponding object. Each geometric component may comprise a respective convex hull. Obtaining the decomposition of the at least one object may comprise performing a convex hull decomposition of each object. The convex hull decomposition method may be computationally efficient.

The representation of the at least one object may comprise a mesh representation, for example a polygonal mesh representation of each object.

The at least one interaction may comprise, for each sound source, at least one occlusion. By providing an audio output that includes the effect of occlusions, a user may experience the audio output as being more realistic than if occlusions were not occluded. By providing more realistic sound, a user experience may be improved.

For each sound source, modelling the at least one occlusion for that sound source may comprise: obtaining relative positions of the sound source, each geometric component, and a position in the scene with respect to which the processing is to be performed; and determining at least one occlusion coefficient in dependence on the relative positions.

For each sound source, modelling the at least one occlusion may comprise determining that one or more of the at least one geometric components is positioned between the sound source and the position in the scene.

Determining the at least one occlusion coefficient may comprise determining a respective occlusion coefficient for each of the geometric components that is positioned between the sound source and the position in the scene.

Determining that a geometric component is positioned between the sound source and the position in the scene may comprise determining at least one occlusion point at which the geometric component intersects a straight line between the sound source and the position in the scene.

Each occlusion coefficient may be dependent on a number of occlusion points and/or a spacing of occlusion points.

The audio input associated with the at least one sound source may comprise, for each sound source, a respective audio signal.

Processing of the audio input may comprise, for each audio signal, adjusting in dependence on the at least one occlusion coefficient for the sound source associated with that audio signal at least one parameter of the audio signal, for example at least one of an amplitude or gain of the audio signal, a frequency spectrum of the audio signal. Changing the amplitude or gain and/or frequency spectrum of audio signals for sound sources that are occluded may provide sound that is perceived by a user to be more realistic.

The method may further comprise selecting the at least one object in dependence on a distance between each object and a position in the scene with respect to which the processing is performed. Selecting the at least one object may comprise selecting at least one object that is within a threshold distance of the position in the scene. Considering only objects that are within a maximum distance may improve computational efficiency. By calculating interactions only for objects that are near the listener, it may be possible to calculate only interactions that provide a significant contribution to the final audio signal.

The at least one interaction may comprise, for each sound source, at least one reflection. By providing an audio output that includes the effect of reflections, a user may experience the audio output as being more realistic than if reflections were not occluded. By providing more realistic sound, a user experience may be improved.

For each sound source, modelling each reflection for the sound source may comprise determining a reflected ray, for example from the sound source to a position in the scene with respect to which the processing is to be performed. Determining a reflected ray may comprise determining a path of the reflected ray. The path of the reflected ray may comprise a portion of the path before reflection and a portion of the path after reflection.

Determining a reflected ray, for example from the sound source to the position in the scene, may comprise determining a reflected ray from the sound source to the position in the scene via a face of a geometric component.

The method may further comprise, for each geometric component, obtaining at least one further component corresponding to the geometric component. Each further component may comprise a representation of a shape, for example a three-dimensional shape. Each further component may comprise a representation of a respective one or more of the geometric component(s), for example a simplified representation of the geometric component(s). Each further component may comprise an oriented bounding box. Each further component may be substantially convex. Each further component may be calculated using a callipers method, for example a 3D vernier callipers method.

Each further component may be a simpler shape than its respective geometric component. Simpler shapes may require fewer CPU cycles to carry out calculations, for example reflection calculations. The calculation of the reflections may be more computationally efficient than may have been the case if a more complex representation of the object were used.

Determining a reflected ray, for example from the sound source to the position in the scene, may comprise determining a reflected ray (for example from the sound source to the position in the scene) via a face of a further component.

Determining a reflected ray from the sound source to the position in the scene via a face of the further component may comprise determining that the face of the further component faces both the sound source and the position in the scene.

The determining of each reflected ray may comprise an image-source method.

The method may further comprise, for each reflected ray, determining whether the reflected ray is obstructed. The method may further comprise, for any reflected ray that is determined to be obstructed, removing that reflected ray and/or determining an occlusion coefficient for that reflected ray.

The processing of the audio signal in dependence on the modelling of the at least one interaction may comprise processing the audio input in dependence on the determined at least one reflection.

The audio input may comprise, for each sound source, a respective audio signal. Determining the at least one reflection for each sound source may comprise determining at least one reflection coefficient for each sound source.

Processing the audio input may comprise, for each audio signal, adjusting in dependence on the at least one reflection coefficient for its associated sound source at least one parameter of the audio signal, for example at least one of an amplitude or gain of the audio signal, a frequency spectrum of the audio signal. Processing the audio input may comprise applying at least one time delay to each audio signal. Changing the amplitude or gain and/or frequency spectrum of audio signals for reflections and/or applying a time delay to reflections may provide sound that is perceived by a user to be more realistic.

Applying at least one time delay to each audio signal may comprise, for each reflected ray determined for the sound source associated with the audio signal, applying a time delay that is dependent on a length of the reflected ray.

The method may comprise registering with a grid each object and/or bounding box and/or convex hull or other geometric component. The method may comprise using a grid based search system to find objects, convex hulls, and/or bounding boxes based on their positions on the grid.

In a further aspect of the invention, which may be provided independently, there is provided an apparatus comprising, for a scene comprising a representation of at least one object and at least one sound source: means for obtaining a decomposition of the at least one object, the decomposition comprising at least one geometric component; means for modelling at least one interaction of the at least one object and the at least one sound source using the at least one geometric component; and, means for, in dependence on the modelling of the at least one interaction, processing an audio input associated with the at least one sound source to obtain an audio output.

In another aspect of the invention, which may be provided independently, there is provided an apparatus comprising a processor configured to, for a scene comprising a representation of at least one object and at least one sound source: obtain a decomposition of the at least one object, the decomposition comprising at least one geometric component; model at least one interaction of the at least one object and the at least one sound source using the at least one geometric component; and, in dependence on the modelling of the at least one interaction, process an audio input associated with the at least one sound source to obtain an audio output.

In a further aspect of the invention, which may be provided independently, there is provided an apparatus comprising a processing resource configured to perform a method as claimed or described herein.

The apparatus may further comprise an input device configured to receive audio input representing sound from at least one audio source. The processing resource may be configured to obtain the audio output by processing the audio input in dependence on the modelling of the at least one interaction. The apparatus may further comprise an output device configured to output the audio output.

In another aspect of the invention, which may be provided independently, there is provided a computer program product comprising computer readable instructions that are executable by a processor to perform a method as claimed or described herein.

There may also be provided an apparatus or method substantially as described herein with reference to the accompanying drawings.

Any feature in one aspect of the invention may be applied to other aspects of the invention, in any appropriate combination. For example, apparatus features may be applied to method features and vice versa.

BRIEF DESCRIPTION OF DRAWINGS

Embodiments of the invention are now described, by way of non-limiting examples, and are illustrated in the following figures, in which.

DETAILED DESCRIPTION OF EMBODIMENTS

Figure 1:
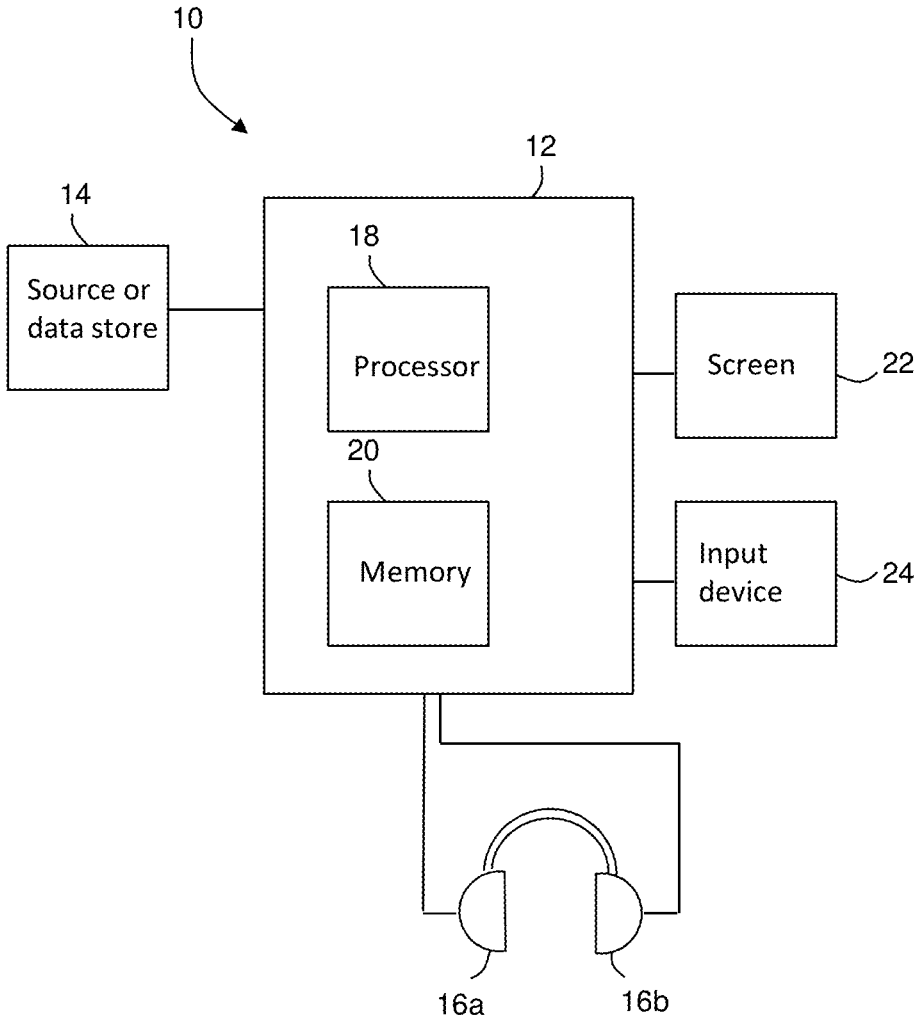
FIG. 1 is a schematic diagram of an audio system according to an embodiment.

An audio system 10 according to an embodiment is illustrated schematically in FIG. 1. The audio system 10 comprises a computing apparatus 12 that is configured to receive monaural audio input from an input device, for example in the form of external source or data store 14, process the audio input to obtain a binaural output comprising a left output and a right output, and to deliver the binaural output to headphones 16*a*, 16*b*. The left output is delivered to left headphone 16*a* and the right output is delivered to right headphone 16*b*. In other embodiments, the binaural output may be delivered to at least two loudspeakers. For example, the left output may be delivered to a left loudspeaker and the right output may be delivered to a right loudspeaker. In some embodiments, the monaural audio input may be generated by or stored in computing apparatus 12 rather than being received from an external source or data store 14.

In further embodiments, any audio input may be used. The audio input may be processed in any appropriate way to produce an audio output to be delivered to headphones, speakers, a surround sound system, or any other suitable audio device. The processing may be such that a user may perceive the audio output as being localized in space.

The computing apparatus 12 comprises a processor 18 for processing audio data and a memory 20 for storing data. The computing apparatus 12 also includes a hard drive and other components including RAM, ROM, a data bus, an operating system including various device drivers, and hardware devices including a graphics card. Such components are not shown in FIG. 1 for clarity.

In the embodiment of FIG. 1, computing apparatus 12 is configured to perform a convex hull decomposition of objects and to generate an oriented bounding box for each convex hull. Computing apparatus 12 is also configured to calculate reflections using the oriented bounding boxes, calculate occlusions using the convex hulls, and use the occlusions and reflections in processing audio input to obtain audio output that includes occlusion and reflection effects. In alternative embodiments, alternative geometric components in place of convex hulls and bounding boxes may be used, for example any suitable representation of shapes for example three-dimensional shapes. The geometric components may comprise a simplified representation of a corresponding object or at least part of the corresponding object.

In other embodiments, audio system 10 may comprise a plurality of computing apparatuses. For example, a first computing apparatus may generate convex hulls and oriented bounding boxes, or other components, and a second, different computing apparatus may calculate occlusions and/or reflections and perform synthesis.

The system of FIG. 1 is configured to perform the methods of the flow charts of FIGS. 2, 3, 10, 11 and 13.

In the present embodiment, a plurality of objects and a plurality of sound sources are positioned in a scene. The scene also comprises a position with respect to which sound is calculated, which may be referred to as the position of a listener. The scene may comprise a part of or the whole of any virtual environment, for example the virtual world of a game.

The computing apparatus 12 is used to model interactions of the objects and sound sources. In the present embodiment, the interactions of the objects and sound sources comprise occlusions and reflections. The computing apparatus 12 is used for a geometry- or object-based calculation of reflections and occlusions.

In the present embodiment, each object is initially represented by a respective 3D polygonal mesh. Each polygonal mesh may comprise a plurality of vertices that may be joined by edges to form faces, in this case triangular faces. Each object may have a complex shape. For example, some objects may represent parts of a scene such as walls, while other objects may represent, for example, people or animals. Therefore, the initial polygonal mesh representation of each object may take any shape. The shape of an object may be complex. The shape of an object may comprise at least one convex portion and/or at least one concave portion. An object may be large and/or the polygonal mesh representation of an object may comprise a large number of vertices.

The plurality of objects are each decomposed into a respective set of convex hulls using convex hull decomposition, as described below with reference to the flow chart of FIG. 2. Each object's mesh data is reduced to one or more convex hulls. If an object is non-convex, it is broken down by the convex hull decomposition into convex parts. Each convex hull may have any appropriate geometrical shape. Each convex hull may be represented by a respective convex hull mesh.

In other embodiments, the objects are each decomposed into any appropriate convex geometrical components. The convex geometrical components may or may not meet the mathematical definition of convex hulls. The geometrical components may be used to calculate occlusion, reflection, or both occlusion and reflection.

Convex hull analysis of a mesh (for example, of a polygonal mesh representing a game object) may return hulls containing new vertices which are not part of the original mesh. Convex hull analysis of a mesh may return hulls whose vertices are a subset of the original mesh vertices, or a combination of new vertices and original mesh vertices.

The resulting convex hulls are used to calculate occlusion and reflection of audio from sound sources as described below with reference to the flow chart of FIG. 11. In other embodiments, the convex hulls may be used to calculate only occlusion (and not reflection) effects or only reflection (and not occlusion) effects.

In the present embodiment, oriented bounding boxes (OBBs) are obtained from the convex hulls and are used in the calculation of reflection. In other embodiments, reflection may be calculated from the convex hulls directly. It may be important for the reflection calculation that the shapes on which the reflection calculations are performed (for example, the oriented bounding boxes) are convex.

In some embodiments, further components (which may or may not be oriented bounding boxes) are used for calculating reflections. The further components may provide a representation of the objects that is simpler than the representation provided by the geometric components. The further components may each approximate a convex hull. The further components may comprise 3D geometrical shapes. The further components may be, for example, cuboids, spheres, or general hexahedrons. The further components may be used in calculating occlusion coefficients, reflection coefficients, or any other appropriate coefficients.

In the present embodiment, if an object is very thin (i.e. if one spatial dimension of the object is of negligible size) then the object (or a convex hull that is representative of at least part of the object) may be approximated by a plane instead of an oriented bounding box. Objects which have negligible size in more than one dimension may be omitted from calculation. For example, no oriented bounding box may be calculated for any object and/or convex hull that is negligible in size in more than one dimension. Other objects are each approximated by at least one oriented bounding box.

Figure 2:
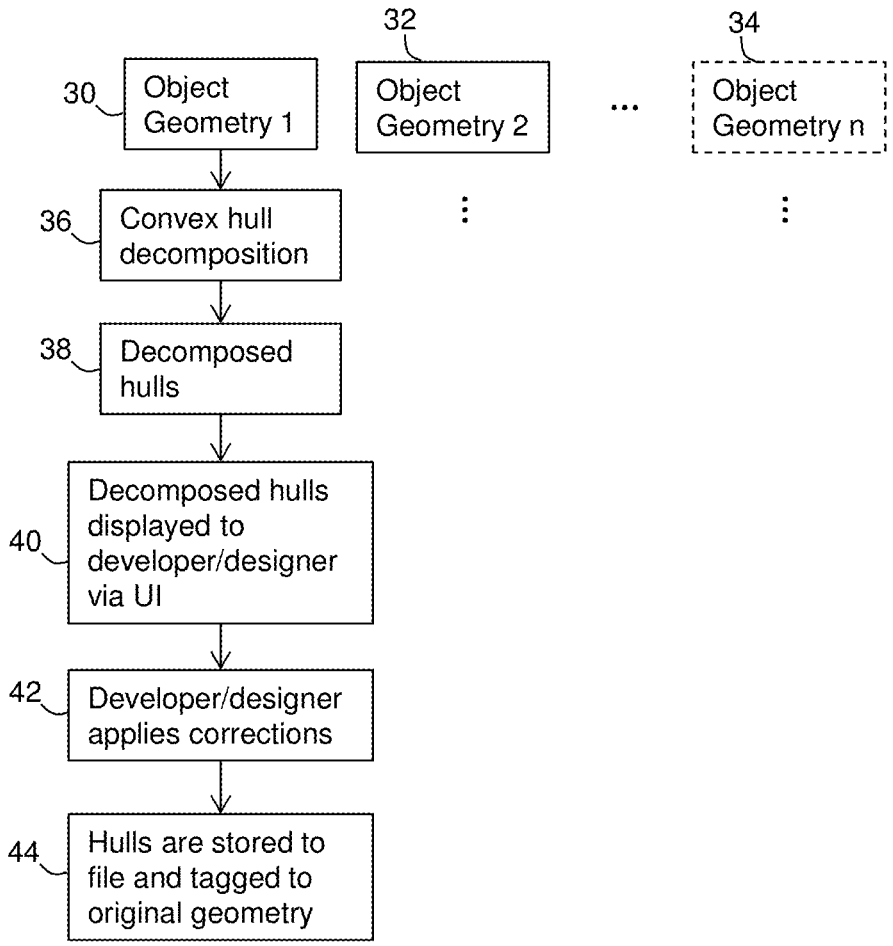
FIG. 2 is a flow chart illustrating in overview a convex hull decomposition method.

FIG. 2 is a flow chart illustrating in overview a process of convex hull decomposition of computer-generated objects. The processor 18 obtains a geometry 30 for a first object, a geometry 32 for a second object and geometries for a further plurality of objects (only one of the further plurality, the geometry 34 for the nth object, is shown in FIG. 2). In the present embodiment, each geometry comprises a 3D polygonal mesh.

A convex hull decomposition process with respect to the first object geometry 30 is described below with reference to stages 36 to 44 of FIG. 2. A similar process is also performed on each of the remaining object geometries, including the second object geometry 32 and nth object geometry 34.

At stage 36, the processor 18 performs a convex hull decomposition of the first object geometry 30, which comprises analysing the first object geometry 30 and representing the first object as a collection of convex hulls 38. In the present embodiment, the processor 18 performs the convex hull decomposition using an HACD (Hierarchical Approximate Convex Decomposition) method, for example a method as described in Khaled Mamou and Faouzi Ghorbel, *A simple and efficient approach for 3D mesh approximate convex decomposition*, Proceedings of the International Conference on Image Processing, ICIP 2009, 7-10 Nov. 2009, which is incorporated by reference herein in its entirety. In other embodiments, the processor 18 may use any suitable convex hull decomposition method. In further embodiments, any suitable geometric components may be used to represent the first object, and any suitable method of obtaining the geometric components may be used.

By decomposing the first object into a plurality of convex hulls, a representation of the first object is obtained that may in some circumstances be simpler than the original 3D polygonal mesh representation of first object geometry 30. In some cases, the representation of the first object that is obtained (in this case, the convex hull) may be described as a simplified representation.

In other circumstances, the convex hulls may be more complex than the mesh that they are approximating. However, in some such embodiments, less computational resources may be used than if using the original mesh representation. For example, less computational resources may be used by approximating objects with simple shapes like boxes etc.

The hull analysis may break down large meshes (which may often be non-convex) into smaller parts. Breaking down larger meshes into smaller parts may be useful for applying algorithms (for example, algorithms calculating reflection and/or occlusion) to only local sections of the map.

In the present embodiment, the coordinates of each object mesh are defined on a local set of axes which may be described as a frame of reference (FoR). The FoR often has its origin somewhere near the geometrical centre of the mesh. In some circumstances, the FoR may have its origin at a corner point.

In the present embodiment, the convex hull decomposition is performed on the object mesh data. Therefore, any convex hull derived from a game object is defined in the game object's local FoR.

An advantage to running the hull analysis in the game object mesh's FoR and not the real world FoR (i.e. the frame of reference of the overall scene) may be that any duplicated game objects still have the exact same mesh whether or not they are in a different real world position, rotation or scale. This means that the convex hull analysis may only need to be run once and the same output hull decomposition may be used by all of these duplicate game objects. This may result in significant performance gains during the analysis process since often game worlds are constructed using many duplicate objects, e.g. floor, wall and ceiling tiles.

The convex hull decomposition method that is used may in some circumstances be similar to a convex hull decomposition technique that may be used for collision detection of objects. The method of convex hull decomposition in this embodiment may be less accurate than a method of convex hull decomposition that may be used in collision detection.

At stage 40, the decomposed hulls 38 resulting from the convex hull decomposition of stage 36 are displayed to a developer or designer via a user interface. In the present embodiment, a rendering of the convex hulls 38 is displayed on display screen 22. In other embodiments, any display method or device may be used.

In some circumstances, the convex hull decomposition of stage 36 may return a set of convex hulls 38 that the developer or designer considers to be incorrect. For example, the developer or designer may consider that the returned set of convex hulls 38 does not correctly represent the first object.

At stage 42, the developer or designer corrects any of the convex hulls that the developer or designer considers to be incorrect. In the present embodiment, the developer or designer may fix any errors through a graphical user interface by moving points on a displayed convex hull using an input device 24, for example a mouse or trackball. In other embodiments, any suitable method for editing the convex hulls may be used. In further embodiments, an automatic convex hull decomposition may be performed without any input from a user (for example, from a designer or developer) and stages 40 and 42 of the process of FIG. 2 may be omitted.

At stage 44, the convex hulls 38 (including any changes made to the convex hulls 38 by the designer or developer at stage 42) are stored in a file. In the present embodiment, the set of convex hulls is stored in memory 20. In other embodiments, the convex hulls may be stored in any appropriate memory. The convex hulls 38 are tagged to associate the convex hulls 38 with the original geometry (in this case, the first object geometry 30). In other embodiments, any method of associating the convex hulls with the object from which they were obtained may be used.

The process of stages 36 to 44 is repeated for each of the objects in the scene to obtain one or more convex hulls for each of the objects. For example, the process of stages 36 to 44 is performed for the second object geometry 32 and for the nth object geometry 34. In other embodiments, only some objects in the scene may be decomposed into convex hulls and other objects may not be decomposed into convex hulls.

In the present embodiment, the process of FIG. 2 is performed offline (not in real time). In other embodiments, the process of FIG. 2 may be performed in real time.

Each object is represented by one or more convex hulls. In some circumstances, more complicated object geometries may be decomposed into a larger number of convex hulls than simpler object geometries. The number of convex hulls may be such that all important features of the original geometry are represented. In some circumstances, for example for embodiments in which the convex hulls are simpler than the original geometries, calculations performed using the convex hulls may require less computational resources than calculations performed using the original geometries.

Breaking down each object (in this case, originally represented by a mesh) into components, for example convex components, may allow reflection calculations to be performed as described below. Breaking down each object into smaller parts may allow calculations (for example, reflection calculations) to be performed on smaller regions than if the original object representation was used.

By allowing a designer or developer to adjust the convex hulls, in some cases a better representation of the object may be obtained than if the process were fully automatic.

The convex hulls obtained in FIG. 2 are used for calculation of occlusions as described below with reference to FIG. 11. However, for the calculation of reflections, it has been found that in some circumstances a further representation that is simpler than the convex hull representation may be used. (In embodiments in which the original objects are decomposed into convex geometric components that are not convex hulls, a further representation that is simpler than those convex geometric components may be used.)

In the present embodiment, the further representation of each object is a representation of the object as one or more oriented bounding boxes. In other embodiments, any further representation of the object as one or more further components may be used. The further components may be of any appropriate geometrical shape, for example cuboids, spheres or general hexahedrons.

Figure 3:
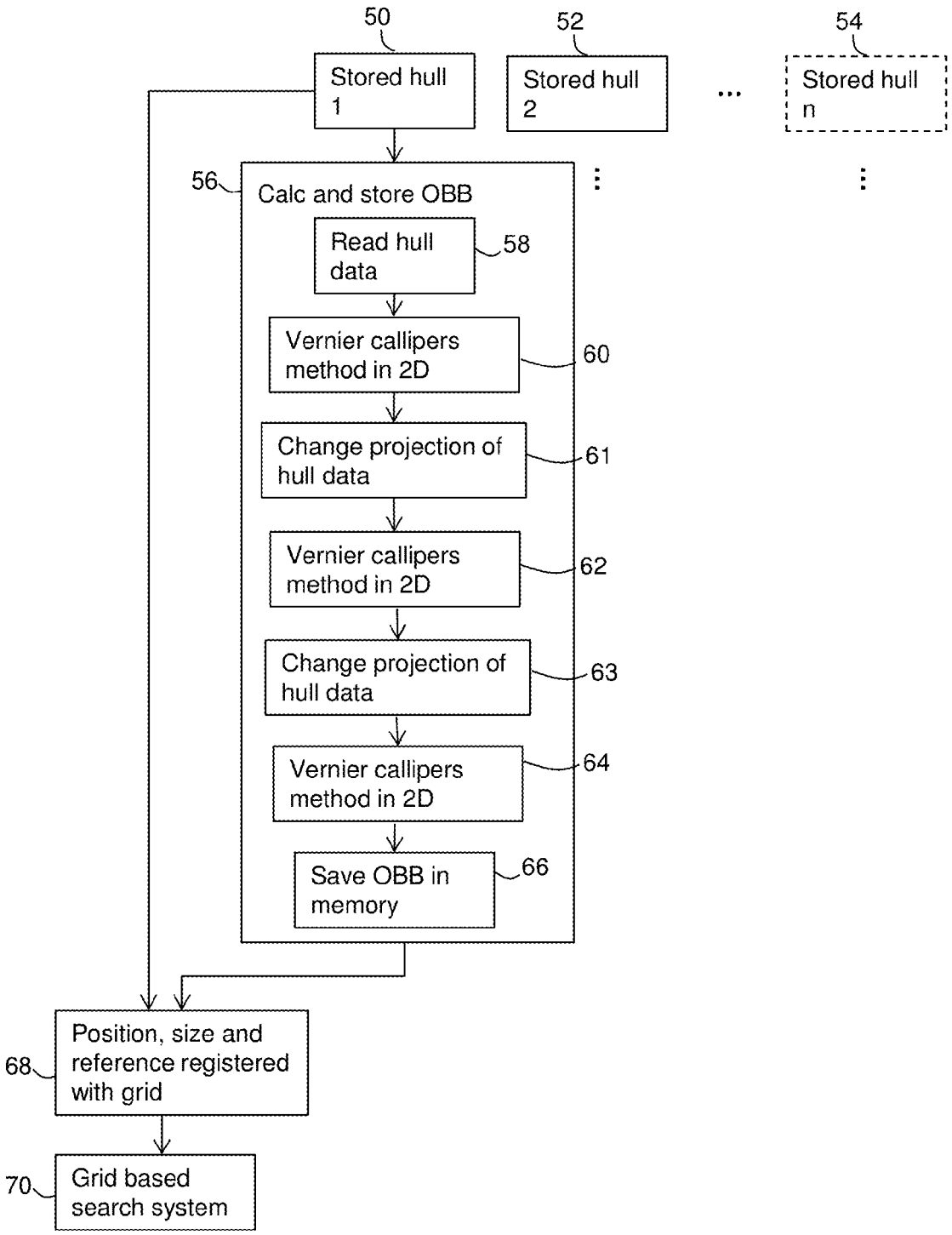
FIG. 3 is a flow chart illustrating in overview a method for calculating oriented bounding boxes.

FIG. 3 is a flow chart illustrating in overview a process of obtaining a respective oriented bounding box (OBB) for each of a plurality of stored convex hulls. Each oriented bounding box may be considered to approximate the convex hull to which it corresponds. In the present embodiment, oriented bounding boxes are obtained for all the convex hulls stored at the end of the process of FIG. 2, i.e. for all convex hulls obtained from all objects in the scene. In other embodiments, oriented bounding boxes may be obtained for a subset of the convex hulls that were stored at the end of the process of FIG. 2.

In alternative embodiments, oriented bounding boxes are obtained from convex hulls that have been obtained using a method other than the process of FIG. 2. In further embodiments, oriented bounding boxes may be obtained for each object using any suitable method, which may or may not comprise a convex hull decomposition. For example, the oriented bounding boxes may be obtained directly from the original representation of the objects, for example from a 3D polygonal mesh representation.

In the process of FIG. 3, the processor 18 obtains a first stored convex hull 50, a second stored convex hull 52 and a further plurality of stored convex hulls (only one of the further plurality, the nth stored convex hull 54, is shown in FIG. 3). The determining of an oriented bounding box for the first stored convex hull 50 is described below with reference to stages 56 to 70 of FIG. 3. A similar process to that of stages 56 to 70 is performed for each of the remaining convex hulls, including the second convex hull 52 and nth convex hull 54.

At stage 56, the processor 18 calculates and stores an oriented bounding box for the first convex hull 50. In the present embodiment, a 3D vernier callipers method is used to calculate the oriented bounding box. In other embodiments, any suitable method of determining the oriented bounding box may be used. The oriented bounding box for the first convex hull 50 may be the minimum-volume cuboid that contains the first convex hull 50.

Stage 56 comprises sub-stages 58 to 66. At sub-stage 58, the processor 18 reads the hull data for the first convex hull 50. The hull data for the first convex hull may be information about the first convex hull that has been stored in memory, for example information that has been stored in memory 20 at the end of the process of FIG. 2.

The 3D vernier callipers method may be an extension of a 2D vernier callipers method to work in 3D. In the present embodiment, the 3D vernier callipers method comprises sub-stages 60 to 64 of FIG. 3.

At sub-stage 60, the processor 18 projects the first convex hull onto a plane and performs a 2D vernier callipers method on the projection of the convex hull onto that plane. In the present embodiment, the first convex hull is projected onto an xy plane at sub-stage 60. In other embodiments, a different plane may be used.

A 2D vernier callipers method that is performed computationally may considered to be analogous to the use of physical vernier callipers. In the present embodiment, the projection of the convex hull is positioned at a first angle relative to the x and y axes. A minimum-area rectangle containing the projection of the convex hull and having sides parallel to the x and y axes is determined. The sides of the rectangle that are parallel to the x axis just touch the highest and lowest points in y of the projection of the convex hull, as if a pair of opposed callipers were applied to the widest extent in y of the projection of the convex hull. The sides of the rectangle that are parallel to they axis just touch the highest and lowest points in x of the projection of the convex hull, as if a pair of opposed callipers were applied to the widest extent in x of the projection of the convex hull.

The projection of the convex hull is then rotated so that it is positioned at a second angle relative to the x and y axis, and a further minimum-area rectangle is determined that has sides that are parallel to the x and y axes and touch the highest and lowest points in x and y of the rotated projection. The rotation of the convex hull and the determining of further minimum-area rectangles is repeated until minimum-area rectangles have been obtained for a full range of rotation of the projection of the convex hull. The processor 18 selects the angle for which the smallest minimum-area rectangle was obtained for the projection of the convex hull.

At sub-stage 61, the processor 18 positions the convex hull at the selected angle relative to x and y and projects the convex hull onto a plane that is perpendicular to the plane of sub-stage 60. In the present embodiment, the processor 18 projects the convex hull onto the xz plane.

At sub-stage 62, the processor 18 determines the smallest minimum-area rectangle for the projection of the convex hull in the xz plane, using the 2D vernier callipers method that is described above with reference to sub-stage 60. The processor 18 selects the angle in the xz plane for which the minimum-angle rectangle is smallest.

At sub-stage 63, the processor 18 positions the convex hull at the selected angle in xz and projects the convex hull onto the remaining plane, in this case the yz plane.

At sub-stage 64, the processor 18 determines the smallest minimum-area rectangle for the projection of the convex hull in the yz plane, using the 2D vernier callipers method that is described above with reference to sub-stage 60. The processor 18 determines the angle in the yz plane for which the minimum-area rectangle is smallest.

At sub-stage 66, the processor 18 determines an oriented bounding box from the smallest minimum-area rectangles determined at sub-stages 60, 62 and 64. The oriented bounding box may be the smallest cuboid that contains the first convex hull 50. The processor 18 saves the oriented bounding box in memory, for example in memory 20.

At stage 68, the processor 18 registers a position, size and reference of the oriented bounding box with a grid. The size may comprise a length in each dimension. A position, size and reference of the convex hull from which the oriented bounding box was obtained is also registered with the grid.

The reference for a convex hull may comprise a unique ID representing that convex hull. The reference for an oriented bounding box may comprise a unique ID representing that oriented bounding box. The reference for a convex hull or oriented bounding box (or other geometric component or further component) may comprise a unique ID representing an object with which it is associated.

The reference to a convex hull or bounding box may comprise an actual memory address to the stored data for that convex hull or bounding box.

The grid may comprise a regular Cartesian grid of lines and/or of points. The grid may be associated with a coordinate system of the scene in which the object may be placed. The grid may be associated with a virtual world. Each position of an OBB or convex hull may be the position of the OBB or convex hull in a coordinate system of the virtual world.

The positions, sizes and references of the oriented bounding box and convex hull are provided to a grid based search system 70. The grid based search system 70 is configured to be used to find objects, convex hulls, and/or oriented bounding boxes based on their positions on the grid. An example of the use of the grid based search system 70 is described below with reference to FIG. 11.

The process of FIG. 3 is repeated to obtain an oriented bounding box for each of the plurality of convex hulls. For example, the process of FIG. 3 is used to obtain an oriented bounding box for second convex hull 52 and for nth convex hull 54. The processor 18 registers the positions, sizes and references of each of the oriented bounding boxes and convex hulls to the grid, and provides the positions, sizes and references to the grid based search system 70.

In the present embodiment, the oriented bounding boxes are calculated offline after convex hull decomposition and user corrections as described above with reference to FIG. 2. In other embodiments, oriented bounding boxes may be calculated in real time. In some embodiments, the process of FIG. 3 may performed in real time as an initialisation process on start-up of an application, for example on start-up of a computer game. The convex hulls may have previously been obtained in an offline process, for example using the process of FIG. 2. Oriented bounding boxes and hulls may be registered to the grid.

In some embodiments, the processes of FIGS. 2 and 3 (obtaining convex hulls and obtaining oriented bounding boxes) are performed together by the same computing apparatus.

Oriented bounding boxes may be calculated in real time if needed for more dynamic geometry. In general, a plurality of objects is added to the grid on start-up. However, the grid may also deal with objects that are created and destroyed during run-time as well as objects moving in space during run-time. In the case of dynamic object creation, any hull analysis and bounding box calculations may be calculated during run time or retrieved from file.

The oriented bounding boxes calculated using the process of FIG. 3 may provide a further representation of the objects in the scene that is simpler than the representation provided by the convex hulls. When the oriented bounding boxes are used in the process of FIG. 11 to calculate reflections, the calculation of the reflections may be more computationally efficient than may have been the case if a more complex representation of the objects were used. For example, reflections may be calculated more quickly using OBBs than would be the case if convex hulls were used instead of OBBs.

Figure 4:
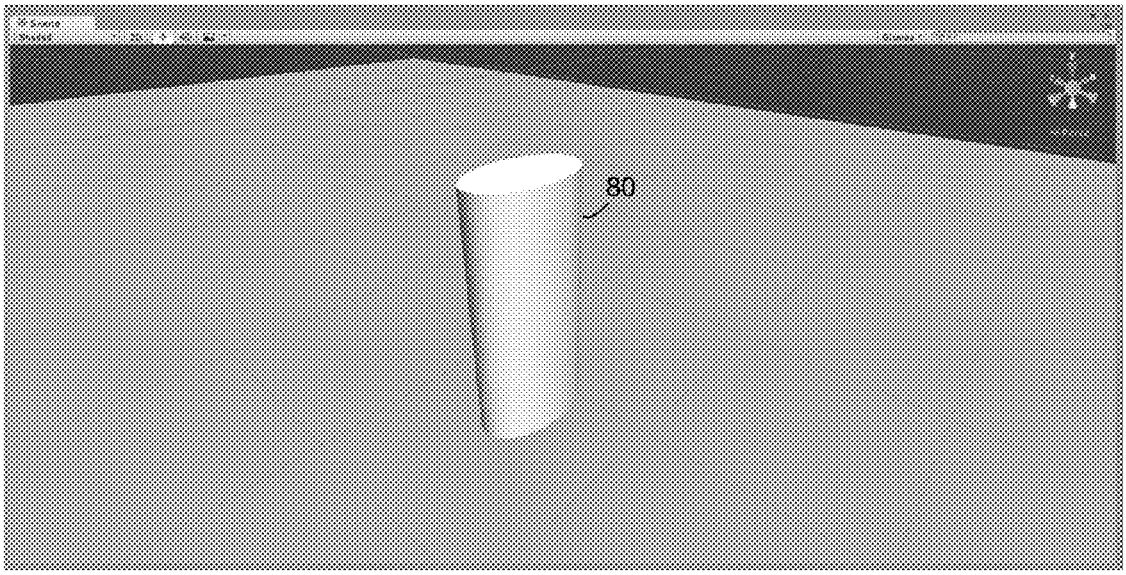
FIG. 4 is a schematic representation of a cylinder.
Figure 5:
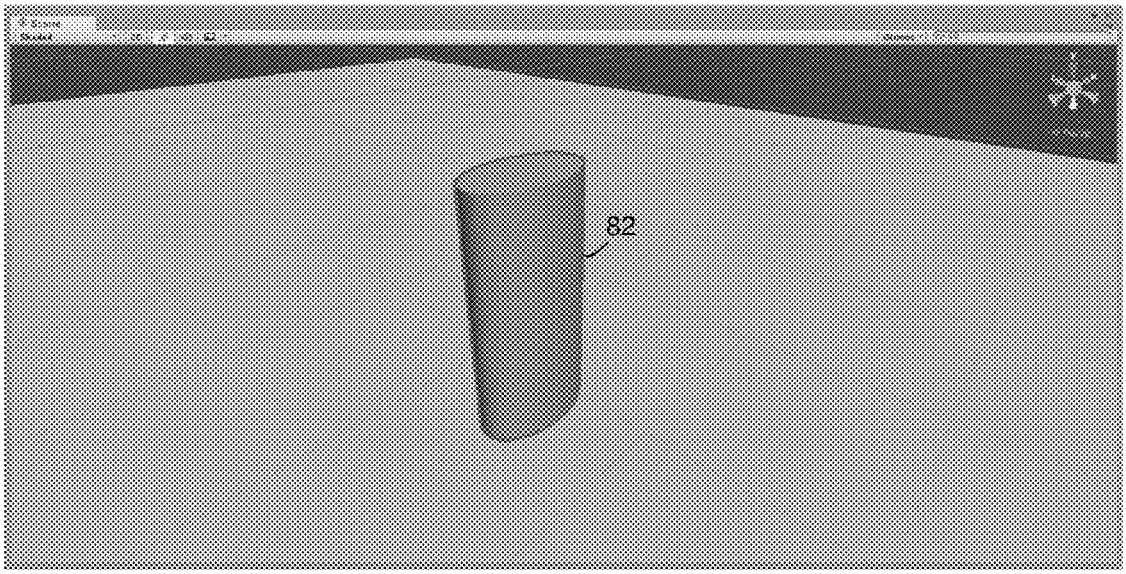
FIG. 5 is a schematic representation of a convex hull of the cylinder of FIG. 4.
Figure 6:
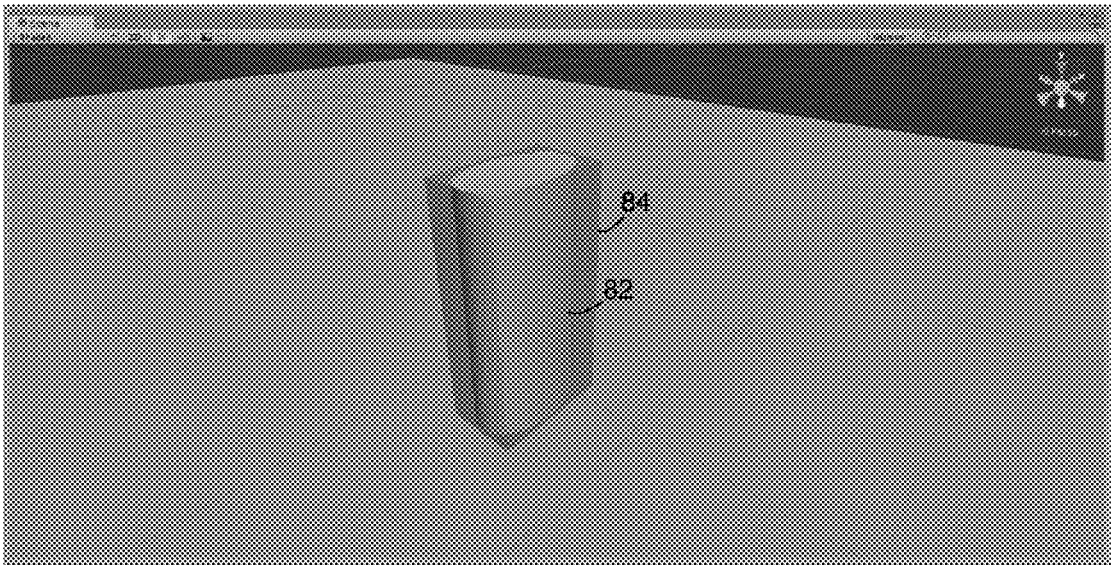
FIG. 6 is a schematic representation of an oriented bounding box of the convex hull of FIG. 5.

Examples of convex hull decomposition and the generation of oriented bounding boxes are illustrated in FIGS. 4 to 9. FIG. 4 shows a cylinder 80, which is an example of an object geometry. FIG. 5 shows a result of a convex hull analysis of the cylinder 80 using the process of FIG. 2. Since the cylinder 80 is a simple shape, a single convex hull 82 is returned by the convex hull analysis. FIG. 5 shows the convex hull 82 around the cylinder 80. FIG. 6 shows an oriented bounding box 84 that is obtained for the convex hull 82 using the process of FIG. 3.

Figure 7:
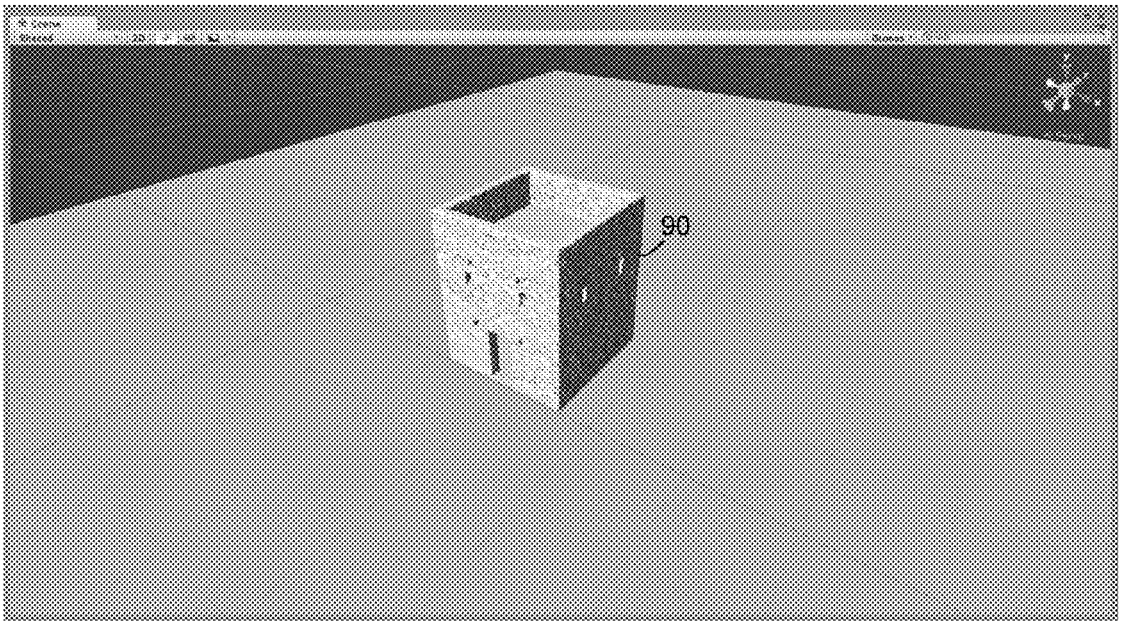
FIG. 7 is a schematic representation of an object.
Figure 8:
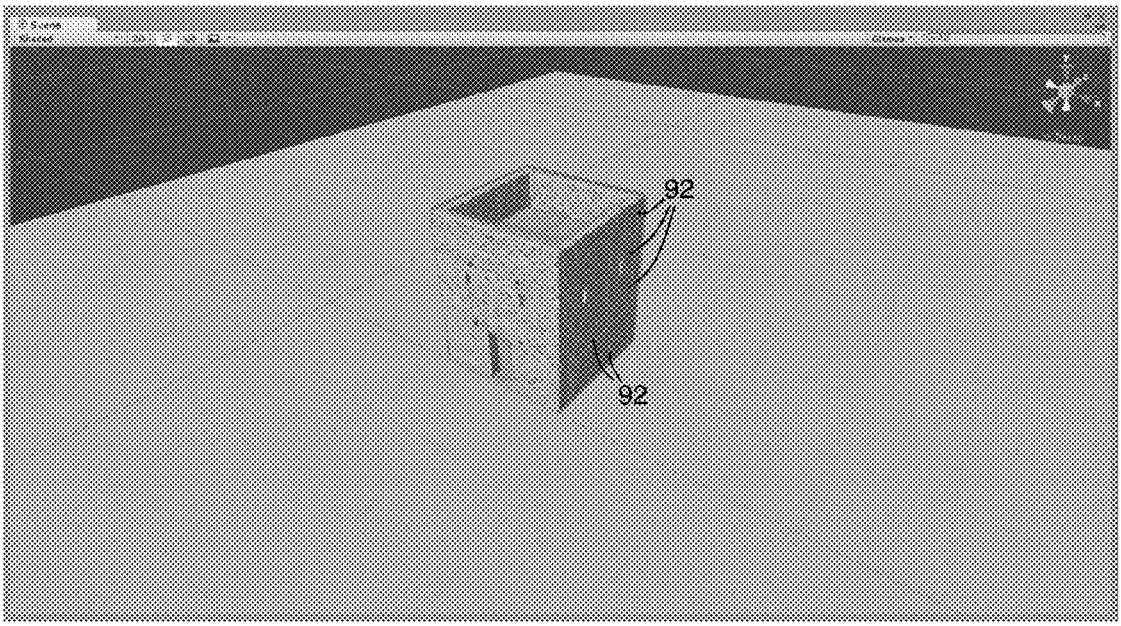
FIG. 8 is a schematic representation of a decomposition of the object of FIG. 7 into a plurality of convex hulls.
Figure 9:
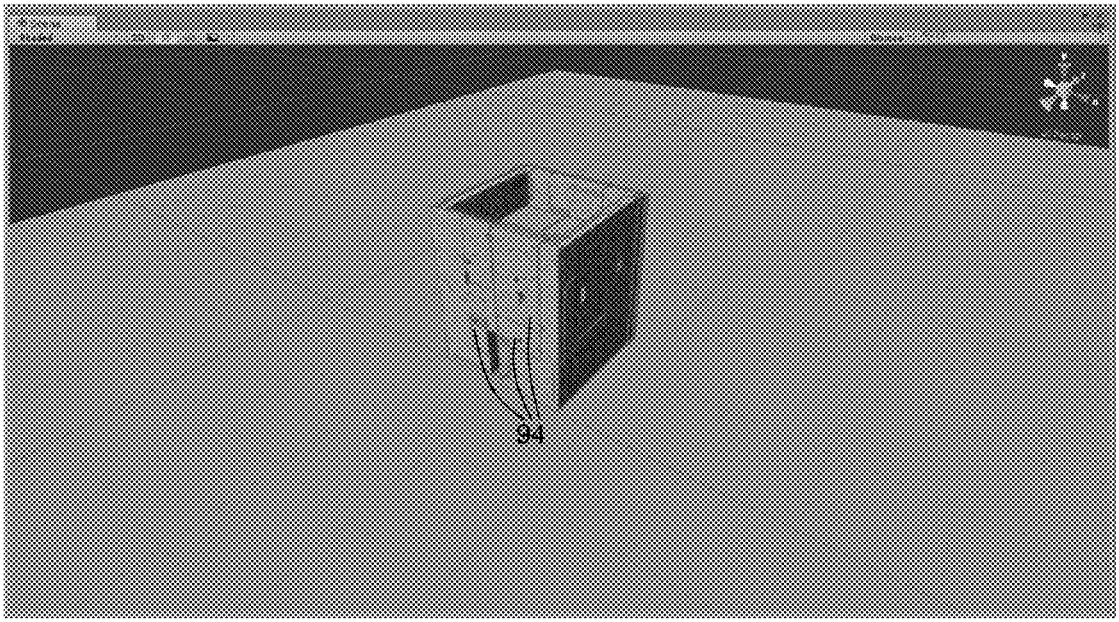
FIG. 9 is a schematic representation of oriented bounding boxes of the convex hulls of FIG. 8.

FIG. 7 shows a more complex object 90. In this example, the more complex object 90 is for use in a game. FIG. 8 shows the result of a convex hull analysis of the object 90 using the method of FIG. 2. The complex game object 90 has been decomposed into multiple convex hulls 92. FIG. 9 shows multiple oriented bounding boxes 94. One oriented bounding box 94 has been generated for each convex hull 92 of the complex game object 90, using the process of FIG. 3.

Figure 10:
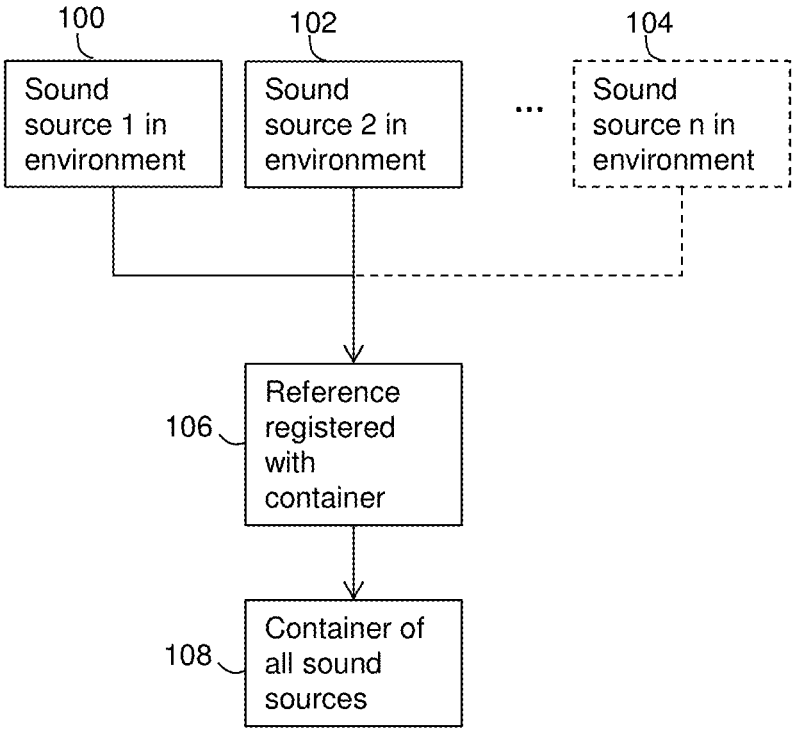
FIG. 10 is a flow chart illustrating in overview the creation of a container of sound sources.

FIG. 10 is a flow chart illustrating in overview a process of registering sound sources to a container. The processor 18 receives information regarding a plurality of sound sources, comprising first sound source 100, second sound source 102 and nth sound source 104. At stage 106, each of the sound sources 100, 102, 104 is registered with a container. The output of the process of FIG. 10 is a container of all sound sources.

The container of sound sources may comprise a list of all currently active sources. The container of sources may be used as an input, for example as an input to the process of FIG. 11. In the process of FIG. 11, the processor 18 may run through occlusion and reflection calculations on each sound source in turn, for all sound sources in the container.

Figure 11:
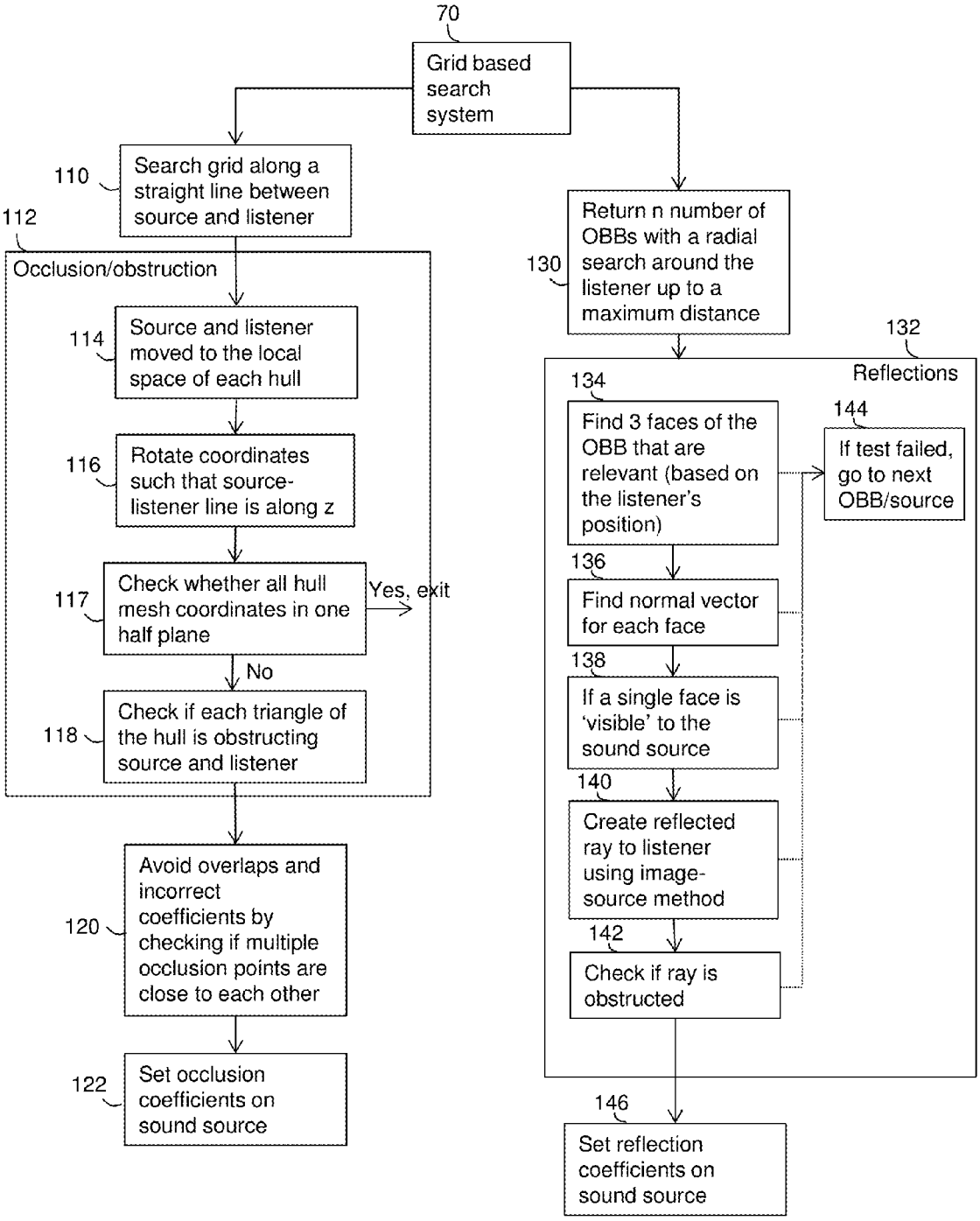
FIG. 11 is a flow chart illustrating in overview the process of an embodiment.

FIG. 11 is a flow chart illustrating in overview the process of an embodiment in which the processor 18 is used to model interactions between a sound source and a plurality of objects, the modelled interactions comprising occlusion of the sound source by the objects and reflection of the sound source by the objects. For the modelling of occlusion, convex hulls are used to represent the objects. For the modelling of reflection, oriented bounding boxes are used to represent the objects. In other embodiments, convex hulls may be used to represent the objects both in the calculation of occlusions and in the calculation of reflections.

The process of FIG. 11 is repeated for each of the sound sources in the scene. Occlusion coefficients and reflection coefficients determined using the process of FIG. 11 are used in the process of FIG. 13 to synthesise sound in which occlusion and reflection effects are present.

In the present embodiment, it has been found that using convex hulls to determine occlusion coefficients gives better resolution than would be obtained by using oriented bounding boxes to determine occlusion coefficients. However, in other embodiments any suitable geometric components or further components may be used for the calculation of occlusion coefficients and reflection coefficients.

In the process of FIG. 11, a grid based search system 70 is used to find convex hulls. In the present embodiment, the convex hulls are those obtained using the process of FIG. 2. In other embodiments, the grid based search system 70 may be used to return objects, oriented bounding boxes, or any other suitable shapes.

When the grid based search system 70 is searched (for example, as described below with reference to stages 112 and 130 of FIG. 11) the grid search returns a list of hull containers. Each container corresponds to a single hull. A container corresponding to a hull contains information for that hull. For example, the container may contain the identity of the hull's parent game object, information such as the object's reflection and occlusion levels (which may be supplied by a user), and precalculated data such as bounding boxes and convex hull mesh data. Any suitable information may be stored in the hull container.

The grid based search system 70 may be used to find objects quickly. The grid based search system may be used to optimise the method of determining reflection and occlusion coefficients.

In the present embodiment, the grid system keeps track of where hulls are in space and allows quick determination of which hulls lie in a particular region in the 3D virtual world. By using a grid based search system, only spatially relevant game objects are passed through to the more CPU intensive processes like occlusion and reflection calculation. The grid itself may not contribute to the calculations of occlusion and reflection.

The grid may provide an indexing system. In other embodiments, any suitable indexing system may be used. The indexing system may provide a way of determining at least an approximate location in the game scene for each object (or, correspondingly, each convex hull or bounding box).

If an indexing system like the grid were not used, any search for game objects may need to loop through all game objects and determine which ones are near to or far from a point of interest (for example, the listener) or which ones occlude or reflect a point or object of interest. Looping through all objects may be very inefficient if one is only interested in a small spatial section of the game scene. By using an indexing system such as the grid, a search may be conducted only on objects that occupy a particular part of the game scene.

In the present embodiment, the grid based search system 70 is implemented in processor 18. In the present embodiment, the convex hulls have been registered to the grid at the end of the process of FIG. 3.

In the present embodiment, the processor 18 determines occlusion/obstruction of each sound source in turn. The sound sources are input as a sound source container (for example, the output of the process of FIG. 10). In other embodiments, the sound sources may be input in any suitable manner.

Stages 110 to 122 of the process of FIG. 11 are described for one sound source. In practice, the processor 18 performs stages 110 to 122 for each of the sound sources in the scene in turn.

At stage 110, the grid based search system 70 is searched using a straight line between the sound source and the positioner of the listener. The search returns any hull that lies in a grid cell that is intersected by a straight line drawn between the sound source and the listener.

At stage 112, each hull found at stage 110 is tested in turn to see if it blocks the line of sight between the sound source and the listener. Stage 112 is described below with reference to a single hull. In practice, stage 112 is repeated for each hull. Stage 112 comprises sub-stages 114 to 118.

At sub-stage 114, the processor 18 transforms the source and listener coordinates into the hull's local frame of reference (FoR). The source and listener are initially defined as coordinates in the world's frame of reference i.e. the frame of reference of the overall scene.

As described above, the local FoR of a hull may be the local FoR of the object to which the hull corresponds. The hull may be defined as a set of mesh coordinates. The mesh coordinates may be defined as coordinates in the mesh's local FoR (the local FoR for the hull) but are associated with a translation, scale and rotation which transform them to the world's FoR. The translation, scale and rotation that transform coordinates from the local FoR of the hull to the world's FoR may be called translation A, scale A and rotation A.

The local FoR of an object may not have a relation to the overall FoR of the scene (which may be referred to as the FoR of the game world) except in that there exists a transformation (comprising translation A, scale A and rotation A) that shifts any coordinate in the object's local FoR to the FoR of the game world. Similarly, there exists an inverse of this transformation.

In the present embodiment, the coordinates of the source and listener and translated then scaled using the inverses of translation A and scale A. At sub-stage 114, the inverse of translation A is used to translate the source and listener coordinates. Scale A relates the scale of the hull's FoR to the scale of the game world FoR scale of reference. The inverse of scale A is then used to scale the source and listener coordinates.

By shifting the source and listener coordinates to the hull's FoR, it may become possible to check whether there is a line of sight past the hull.

At sub-stage 116, the processor 18 defines a rotation B that rotates a vector pointing between the source coordinate and the listener coordinate such that it becomes a vector parallel to the z axis. Rotation B rotates the source and listener coordinates to lie parallel to the x axis.

To get the mesh coordinates rotated correctly in relation to the new source and listener positions, the processor 18 applies rotation A then rotation B to all of the mesh coordinates. In the present embodiment, the rotation is implemented by combining rotation A and rotation B into one rotation.

The processor 18 applies the defined rotation to the source and listener coordinates such that the line of sight between the source coordinate and the listener coordinate becomes parallel to the z axis.

The processor 18 applies the defined rotation to every coordinate of the mesh of the hull in combination with any rotation of the game object that may occur in the game world. The issue of finding whether a hull blocks the line of sight between the source and the listener is thereby reduced from a 3D issue to a 2D issue. Z coordinates may be ignored at this stage. The processor 18 may need only to determine whether the (x,y) coordinates of the source and listener coordinates lie inside a 2D projection of the mesh onto the (x,y) plane. In this method, the (x,y) coordinates of the source are at this stage the same as the (x,y) coordinates of the listener.

In the present embodiment, the processor 18 also translates the (x,y) components of the rotated mesh coordinates such that the source and listener (x,y) positions are at the origin. All coordinates are shifted so that the source and listener (x,y) coordinates are at the origin.

Since the source and listener (x,y) coordinates are at the origin, one check for line of sight blocking comprises determining if all mesh coordinates of the hull lie in one half plane. At sub-stage 117, the processor 18 determines whether all mesh coordinates lie in one half plane. The processor 18 determines if all mesh coordinates lie in positive x, if all mesh coordinates lie in negative x, if all mesh coordinates lie in positive y, and if all mesh coordinates lie in negative y. If all the mesh coordinates lie in one half plane (for example, in positive x) it is not possible that the hull may block a line of sight along (0,0). If it is determined that all mesh coordinates for a given hull lie in one half-plane, the processor 18 exits stage 112 for that hull, and starts a new iteration of stage 112 for a further hull.

If the processor 18 determines that it is not the case that all mesh coordinates lie in one plane, there is no exit at sub-stage 117 and the process proceeds to sub-stage 118.

In some other embodiments, sub-stage 117 is omitted or a different test is used at sub-stage 117.

At sub-stage 118, the processor 18 checks whether each triangle of the hull is obstructing the source and the listener by checking if the line of sight gets blocked by any triangle in the mesh. At this stage, the line of sight problem has already been reduced to a 2D problem. By reducing the line of sight problem to a 2D problem, the number of calculations needed to determine whether each triangle obstructs the line of sight may be greatly reduced.

If the processor 18 finds a triangle that contains the origin (which is the intercept point), then the processor 18 checks that the triangle is actually in between the source position and the listener position. The processor 18 ensures that the triangle's intercept with the z axis is between the z coordinates of the source and listener.

If a triangle of the convex hull is found to be obstructing the line between the source and the listener, the processor 18 records the point at which the triangle obstructs the line between the source position and the listener position (here, the z axis) as an occlusion point. In other embodiments, the convex hull may comprise facets that are not triangular. The processor 18 may determine whether each facet of the convex hull obstructs the line between the source and the listener.

The process of sub-stages 114 to 118 may ensure that, on average, close to the minimum possible number of calculations are performed in order to determine if a hull is blocking the line of sight between the source and listener positions.

The processor 18 performs stage 112 for each of the convex hulls that were returned at stage 110. The output of all the iterations of stage 112 may be no occlusion points (if no convex hull occludes the sound source), one occlusion point, or a plurality of occlusion points. The processor 18 passes the output of all iterations of stage 112 to stage 120.

At stage 120, if the iterations of stage 112 have returned a plurality of occlusion points, the processor 18 checks whether multiple occlusion points are close to each other. In the present embodiment, all the occlusion points are points on the line between the sound source and the listener. The processor 18 determines whether a distance between two or more of the occlusion points is below a threshold distance.

In some circumstances, two or more occlusion points may be close to each other because the two or more occlusion points are from different triangles of the same convex hull. In some circumstances, the two or more closely separated occlusion points may be from different convex hulls of the same object.

In some circumstances, the two or more closely separated occlusion points may be from different objects. The different objects may be very close to each other. In some circumstances, two obstructing objects may have an overlap on the line between the source and the listener.

At stage 122, the processor 18 sets at least one occlusion coefficient for the sound source. If the sound source is not occluded, the processor 18 sets the occlusion coefficient for the sound source to 0. An occlusion coefficient of 0 means that the sound is not altered at all. A completely blocked sound would have an occlusion coefficient of 1. An occlusion coefficient of 1 means that no sound may be heard. For values between 0 and 1, a higher value of the occlusion coefficient corresponds to a greater occlusion.

In other embodiments, if the sound source is not occluded, the processor 18 sets the at least one occlusion coefficient to a fixed value, for example to 1. In further embodiments, if the sound source is not occluded, the processor 18 does not calculate an occlusion coefficient for the sound source.

The processor 18 determines at least one occlusion coefficient based on details of any occlusions that have been obtained at stage 112 and checked at stage 120. One or more hulls may occlude the sound source.

Each occluding hull provides a respective occlusion coefficient which can depend on a number of factors: how long the line of intersection with the hull is, how large the hull or parent game object is and a user defined occlusion level for the game object. The coefficients for each occluding hull are then weighted in relation to their distance from the listener before being summed to obtain a final and single occlusion coefficient to be applied to a particular source.

The processor 18 may determine an occlusion coefficient for a sound source in dependence on a number of occlusion points, and the spacing of those occlusion points. In some circumstances, a set of closely spaced occlusion points may be treated as a single occlusion for the purposes of the occlusion coefficient calculation. For example, if two objects overlap only by a small amount on the line between the sound source and the listener, the occlusion coefficient may be calculated as if there were a single object between the source and the listener. By contrast, if two objects overlap by a large amount, a greater occlusion coefficient may be determined than if a single object were present.

If two objects are widely separated along the line, they may be considered as forming separate occlusions, each of which contributes to the occlusion coefficient. By checking at stage 120 whether multiple occlusion points are close to each other, the processor 18 may avoid overlaps. The processor 18 may avoid incorrect coefficients.

Each occlusion coefficient may depend on a distance between the listener and the sound source and/or a distance between the listener and the occlusion. For example, if the sound source is far away from the listener, the processor 18 may calculate a lower occlusion coefficient for a given occlusion than if the sound source had been closer to the listener but occluded by the same occlusion.

The process of stages 110 to 122 is iterated through all sound sources in the environment. For each sound source, a set of hulls is determined at stage 110 based on a grid search along a straight line between the sound source and the listener and those hulls are tested at stage 112 to determine whether they occlude the sound source.

The output of all the instances of stage 122 is an occlusion coefficient for each sound source (some of which may be 0 if some sources are not occluded). In other embodiments, no occlusion coefficients are calculated for non-occluded sound sources.

In the present embodiment, for each sound source, occlusion coefficients resulting from occlusion by different convex hulls are summed and weighted to obtain a single occlusions coefficient for the sound source. The single occlusion coefficient is used in binaural synthesis as described in FIG. 13.

In other embodiments, multiple occlusion coefficients for each sound source may be used in the binaural synthesis.

A non-zero occlusion coefficient for a sound source results in a reduction of amplitude of an audio signal from that sound source as is described below with reference to FIG. 13. A low-pass filter may also be applied to change the frequency of an audio signal from a sound source that is occluded.

Although a particular method of determining occlusions is described above, in other embodiments any appropriate method of determining occlusions may be used.

By determining occlusions using convex hulls, more accurate results may be obtained than if occlusions were determined using simpler components, for example using oriented bounding boxes. Nonetheless, there are some embodiments in which occlusions are determined using oriented bounding boxes.

In the method described above with reference to stages 110 to 122, a straight line grid search is used to find hulls that may contribute to occlusion. In other embodiments, instead of a straight line grid search at stage 110, a larger area between the source and listener is searched for hulls that may contribute.

In one embodiment, at stage 110, the processor 18 searches all of the cells of the grid that are in a region defined by a prolate spheroid (rugby ball shape) drawn such that its major axis lies along the straight line between the source and the listener and the source and the listener lie on the perimeter of the prolate spheroid.

In other embodiments, at stage 110, the processor 18 searches all of the cells of the grid that are within a cuboid-shaped region that lies along the straight line between the source and the listener. The cuboid may be considered to approximate the prolate spheroid region described above. In further embodiments, a grid region of any appropriate shape may be searched.

By searching a region shaped like a prolate spheroid, cuboid, or any other suitable shape, the occlusion coefficient calculation may also take into account hulls that may represent interconnected occluding game objects, and may therefore gain a more accurate idea of the overall size of the occluding object.

In some embodiments, occlusion calculations return information about a size of an occluding object or objects. The occlusions calculations may return information about how sound may diffuse around the sides of the object. By including the size of the object, a directional element may be added to the occlusion. The directional element may be in addition to a change in filtering and drop in level of a direct sound source as described below with reference to FIG. 13.

Turning to the calculation of reflection coefficients, at stage 130, the processor performs a radial search of the grid that was searched by straight line at 110. The grid based search system 70 returns all convex hulls that are found by a radial search around the listener up to a given maximum distance. The convex hulls are returned as a list of hull containers as described above. Each hull container corresponds to one convex hull. Hull information or bounding box information can be queried from the list of hull containers. For example, each hull container comprises precalculated bounding box data for an oriented bounding box corresponding to the convex hull. The hull containers may also provide further information as described above, for example the identity of the hull's parent game object and the object's reflection and occlusion levels.

The OBBs corresponding to the convex hulls found by the grid based search system at stage 130 are used for the calculation of reflection coefficients for each of the plurality of sound sources.

In other embodiments, a different search system or indexing system may be used to find oriented bounding boxes (or other components) within a maximum distance of the listener.

Considering only OBBs that are within a maximum distance may improve computational efficiency. By performing reflection coefficient calculations only for reflections that are near the listener, it may be possible to calculate only reflections that provide a significant contribution to the final audio signal. In some circumstances, reflections that occur far away from the listener may not result in a perceptible difference in the audio signal.

Stage 132 is described for a single sound source. In practice, stage 132 is performed for each of the sound sources in the scene.

At stage 132, the processor 18 determines, for each of the OBBs, any reflections of the sound source from that OBB. In the present embodiment, only first order (single bounce) reflections are included. In other embodiments, higher order (multiple bounce) reflections may be included.

Stage 132 comprises sub-stages 134 to 144. At sub-stage 134, the processor 18 finds up to three faces of the OBB that are relevant to the reflection process. The faces that are considered to be relevant are faces that face the position of the listener. In the present embodiment, the listener is considered to be a point and a relevant face is any face that faces the point (even if the face is behind the listener). In other embodiments, the listener may be considered to be a non-point source, i.e. the listener may be considered to have a non-zero physical size The further faces of the OBB (the faces that do not face the listener) will not reflect sound towards the listener and therefore are neglected.

At sub-stage 136, the processor 18 determines a normal vector for each of the faces of the OBB that have been determined to be relevant at sub-stage 134.

At sub-stage 138, the processor 18 determines whether each of the relevant faces is visible to the sound source. In the present embodiment, each sound source is considered to be a point source. In other embodiments, each sound source may be considered to be a non-point source, i.e. each point source may be considered to have a non-zero physical size.

A face that is visible to the sound source may be a face that faces the sound source at any orientation. For example, a face may be facing a sound source regardless of whether it is in front of or behind the sound source.

In the present embodiment, sub-stage 138 uses the same process as was described above with reference to stage 112 to determine which faces, out of the set of faces visible to the listener, are visible to the source. In other embodiments, any suitable method may be used. Sub-stage 138 finds the visible faces that are common to both the source and the listener.

If there are no common faces then there are no reflections from the bounding box. Also, if there is more than one common face, then the source and listener are also in a position where they are unable to allow a reflection. Thus a reflection from a box is only possible if both source and listener have exactly one visible face in common.

The test of sub-stage 138 is passed if the source and listener have exactly one visible face in common.

If the test of stage 138 is failed (that is, if no face is visible to both sound source and the listener, or if more than one face is visible to both the sound source and the listener), the processor 18 does not perform sub-stages 140 and 142 on the current combination of OBB and sound source. We exit the process of stage 132 for this particular bounding box. The flow chart moves to sub-stage 144, in which the processor 18 proceeds to the next combination of OBB and sound source.

At sub-stage 140, for each face that has been determined to be visible to both the listener and the sound source, the processor 18 creates a reflected ray from the sound source to the listener using the image-source method. A simple example of use of the image-source method is illustrated in the schematic diagram of FIG. 12. In other embodiment, any method of calculating reflection may be used. For example, a ray tracing method may be used.

Figure 12:
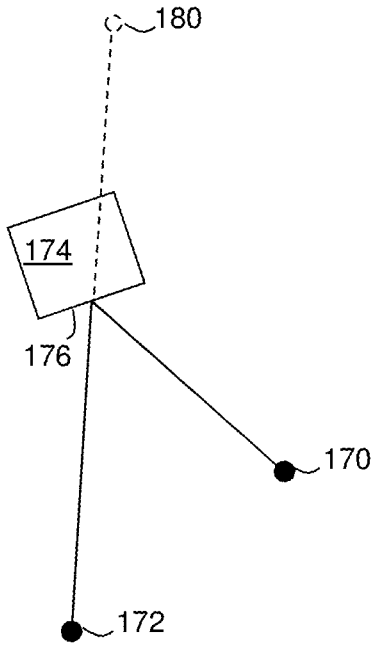
FIG. 12 is a schematic diagram representing a reflected ray.

FIG. 12 shows a sound source 170, a listener 172 and an object 174. Face 176 of object 174 faces both the sound source 170 and the listener 172. Sound emitted by sound source 170 reflects from face 176 and is received by the listener 172.

In the image source method, an image 180 of the sound source is created by reflecting the position of the sound source in the plane of face 176. The image 180 may be considered to be an additional sound source when calculating the contributions of sound sources to an audio output.

Sub-stage 140 determines the actual location of the reflection point using the image source method. Note that the image source method returns a reflection coordinate which lies on the infinitely extended plane coincident with the face, not necessarily a reflection point which lies on the face. The processor 18 therefore determines if the reflection point is actually on the face. If the determined reflection point is not on the face, then we exit the process of stage 132 for this particular bounding box. The flow chart moves to sub-stage 144, in which the processor 18 proceeds to the next combination of OBB and sound source.

It has previously been known to use the image-source method to calculate reflection in a cuboidal shape room. In the present embodiment, the image-source method is extended to work with single faces of an OBB.

The method of the present embodiment breaks down objects, which may have arbitrarily shaped geometry, firstly into hulls or other components and then each hull can be approximated by a simpler shape (in this embodiment, an OBB). Simpler shapes may require fewer CPU cycles to carry out occlusion and reflection calculations. The method of the present embodiment approximates hulls as either boxes, planes or as negligible if the hull is too small. This information is used when a hull container is returned from a grid search. Note that if the hull is approximated by a plane then the reflection calculations requiring bounding box faces use the double sided face of the plane.

In other embodiments, a spherical approximation or a general hexahedron approximation to a hull may be used instead of an oriented bounding box.

At sub-stage 142 of the process of FIG. 11, the processor 18 checks whether the ray obtained from the image source method is obstructed. The processor 18 determines whether any object lies on the ray between the sound source and the face from which the sound is reflecting (for example, face 176), or between the face from which the sound is reflecting and the listener.

Sub-stage 142 distinguishes two straight lines of sight, one from source to reflection point and one from reflection point to listener. The processor uses a straight line grid search (in this embodiment, the same type of straight line grid search as described above with reference to stage 110) to find bounding boxes in grid cells along each straight line. The processor 18 determines if any bounding box blocks either straight line of sight using a method similar to that described above with reference to stage 112, but using oriented bounding boxes rather than hulls to determine occlusion.

For each reflection, if any bounding box blocks either of the lines (between source and reflection point, or between reflection point and listener) then the reflection is ignored and we exit the process of stage 132 for this particular bounding box. The flow chart moves to sub-stage 144, in which the processor 18 proceeds to the next combination of OBB and sound source.

In the present embodiment, occlusion effects on reflections are not considered. Any reflection that is found to be occluded is ignored in subsequent calculations. In other embodiments, occlusions for reflections may be calculated, for example by using the method described above with reference to stages 110 and 112. One or more occlusion coefficients may be calculated for each reflected ray.

In other embodiments, the straight line search for each reflection is instead used to return hulls rather than bounding boxes. The blocking of reflections is determined from the hulls by the same methods as that of the direct source/listener occlusion. This may be more accurate but more CPU intensive than calculating occlusions of reflections based on OBBs.

In the present embodiment, the processor 18 determines whether any object lies on the ray using an occlusion method similar to that described above with reference to stages 110 and 112, but there is no occlusion coefficient calculation for reflections. If a reflected ray is blocked at all then it is discarded.

In other embodiments, occlusion coefficients may be calculated for the reflected rays. Reflected rays that are blocked may be occluded rather than discarded. Occlusion of reflected rays may be calculated using any suitable method.

Stage 132 is repeated for every combination of OBB and sound source. At stage 146, at least one reflection coefficient is set for each face from which sound is found to be reflected. For each face, the at least one reflection coefficient may be dependent on the distance of the sound source from the listener along the reflected ray. The at least one reflection coefficient may be dependent on a reflection level associated with the OBB. A given sound source may be reflected from several faces (one for each of several OBBs). Therefore, a given sound source may have several reflection coefficients, at least one for the reflected ray from each face.

The process of stages 132 and 146 iterates through all sound sources in the environment. Each sound source is tested against each of the OBBs returned in the radial search of stage 130.

The output of all iterations of stage 146 comprises a reflection coefficient for each reflected ray. In other embodiments, the output of stage 146 comprises at least one occlusion coefficient for each reflected ray that is also occluded.

For each reflected ray determined for a given sound source, a delayed version of an audio signal from that sound source is added to the original audio signal from that sound source in the process of FIG. 13 as described below. The image source distance from the listener (which is the same as the length of the reflected ray) is used to determine a time delay of the delayed version of the audio signal. The value of the reflection coefficient for the reflected ray, in combination with the image source distance from the listener, is used to determine an amplitude of the delayed version of the audio signal and a filtering level of the delayed version of the audio signal. Where a given sound source has a plurality of reflections from different faces, several reflected rays may be associated with that sound source, resulting in several delayed versions of the audio signal.

In the present embodiment, OBBs are returned at stage 130, and reflections from faces of the OBBs are determined at stage 132. In other embodiments, convex hulls may be returned at stage 130, and reflections from facets of the convex hulls may be determined at stage 132. Such embodiments may be more computationally intensive than embodiments in which OBBs are used. In further embodiment, reflections and/or occlusions may be determined from any simplified representation of objects in the scene, or any further representation of objects in the scene.

In the present embodiment, the output of the process of FIG. 11 is an occlusion coefficient for the direct path from each sound source to the listener, and a reflection coefficient (and, optionally, at least one occlusion coefficient) for each reflected path from any sound source to the listener. The occlusion and reflection coefficients are used in a binaural synthesis process in FIG. 13.

In the present embodiment, the calculation of occlusions and reflections happens every frame, which in the present embodiment is 60 times a second. In other embodiments, occlusions and reflections may be calculated at any appropriate time interval. In the present embodiment, occlusions and reflections are calculated in real time. In other embodiments, occlusions and reflections may be calculated in a non-real time process.

Figure 13:
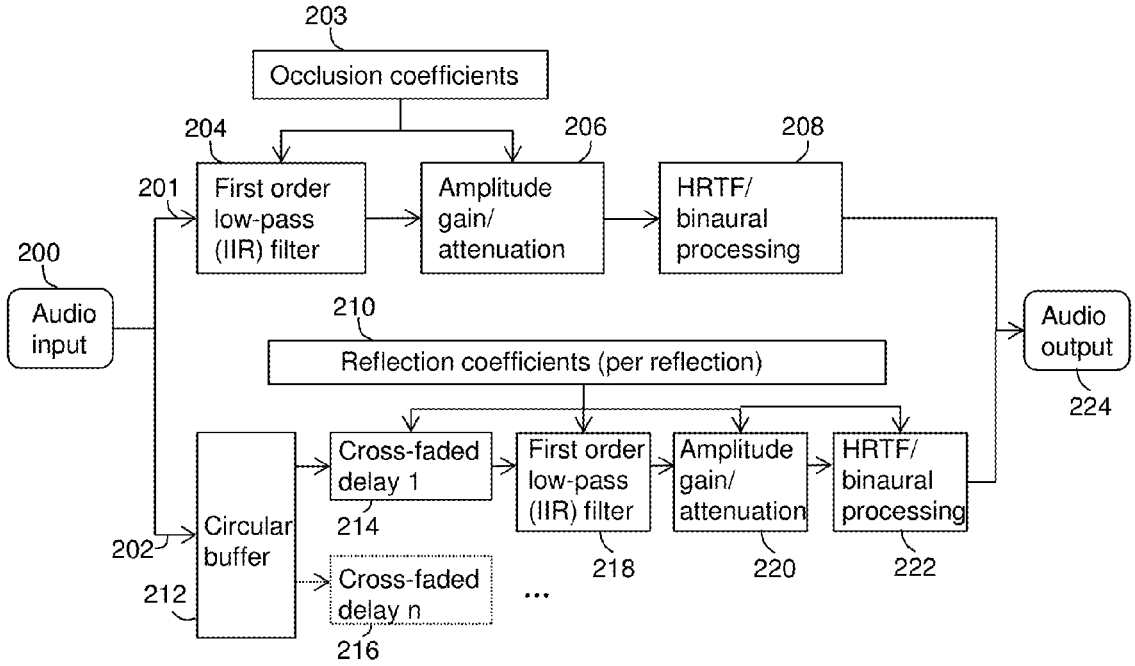
FIG. 13 is a flow chart illustrating in overview the process of an embodiment.

FIG. 13 is a flow chart illustrating in overview a process of occlusion and reflection DSP (digital signal processing) during run time. In the present embodiment, the process of FIG. 13 is performed in real time. In other embodiments, the process of FIG. 13 may be performed offline (not in real time).

In the process of FIG. 13, monaural audio input is processed to obtain binaural audio output. The audio input comprises audio signals associated with each of the plurality of sound sources. Occlusion and reflection coefficients calculated using the process of FIG. 11 are applied to each source's DSP path. Each source has two signal paths, direct sound and reflected sound. For a given source the reflected sound path may comprise a plurality of reflections.

In other embodiments, any suitable audio input may be processed to obtain appropriate audio output. For example, audio input may be processed to obtain audio output to be delivered to speakers or a surround sound system. The audio output may comprise two or more audio output channels.

The occlusion coefficient for a source is applied to the direct sound for that source by controlling a low-pass filter 204 (and/or a high shelf filter) and a gain module 206. The reflection coefficients are applied to the reflected sound path, which is made up of N number of delay lines 214, 216.

The process of FIG. 13 is described below with reference to a single audio signal associated with a single audio source. In practice, the process of FIG. 13 is performed for an audio input that comprises respective audio signals associated with multiple sound sources, each sound source having an associated at least one occlusion and/or reflection coefficient.

Audio input 200 is received by the processor 18. The processor 18 processes direct sound in a first branch 201 of the process of FIG. 13, and processes reflected sound in a second branch 202 of the process of FIG. 13. In the present example, the audio input 200 comprises an audio signal from a single sound source. The processor 18 receives an occlusion coefficient 203 associated with the sound source, and at least one reflection coefficient 210 associated with at least one reflection from the sound source.

In the first branch 201 (direct sound), the audio input 200 and occlusion coefficients 203 are supplied to a first-order low pass IIR (infinite impulse response) filter 204. In other embodiments, the first-order low pass filter 204 may be replaced or supplemented by a higher-order high shelf filter. The low pass filter 204 is used to damp the sound in dependence on the occlusion coefficient. If a sound source is occluded, the low pass filter 204 reduces high frequency components of that sound source in comparison to lower frequencies. In the present embodiment, the low-pass filter 204 is implemented in software in processor 18. In other embodiment, any hardware or software implementation of low-pass filter 204 may be used.

The output of the low-pass filter 204 is passed to gain module 206. Gain module 206 applies an amplitude gain or attenuation to the output of the low pass filter 204 in dependence on the occlusion coefficient. In the present embodiment, the gain module 206 is implemented in software in processor 18. In other embodiment, any hardware or software implementation of gain module 206 may be used.

The output of the gain module 206 is passed to an HRTF or binaural processing module 208. The HRTF or binaural processing module 208 processes the output of the gain module 206 to obtain a binaural output comprising a left output and a right output. In the present embodiment, the processing comprises binaural processing using HRTF coefficients. In other embodiments, any method of binaural processing may be used. In the present embodiment, HRTF or binaural processing module 208 is implemented in processor 18. In further embodiments, any hardware or software implementation in any device may be used. In some embodiments, the processing does not comprise binaural processing.

In the direct sound branch 201 of FIG. 13, the occlusion coefficient is used to apply damping (via low pass filter 204) and amplitude attenuation or gain (via attenuation/gain stage 206) to the direct sound. In the reflected sound branch 202 of FIG. 13, reflection coefficients are used to apply damping and amplitude attenuation or gain, and, for each reflection, an image source distance from the listener is used to apply delay.

FIG. 13 illustrates the processing of one reflection from one sound source in detail. In practice, for each of a plurality of sound sources, there may be multiple reflections, each reflection having a corresponding reflected ray. Each reflection may have a different reflection coefficient (and, in other embodiments, a different occlusion coefficient). Each reflection may be considered to be an additional sound source.

The audio input 200 is provided to a circular buffer 212. In this example, the audio input 200 comprises an audio signal from a single sound source. The circular buffer 212 provides the audio input to a first cross-faded delay line 214. A reflection coefficient for the reflection of interest is provided to the first cross-faded delay line 214, and also to a low-pass filter 218, gain module 220, and HRTF or binaural processing module 222.

The first cross-faded delay line delays the audio signal to an extent that is determined by the image source distance from the listener for that reflection, which is representative of a distance from the sound source to the listener via the reflected ray for the reflection in question. Other reflections may be passed to different cross-faded delay lines, for example to the nth cross-faded delay line 216. The reflection coefficient (in combination with image source distance from the listener) determines the amplitude of reflection and filtering level of the reflection.

The output of the first cross-faded delay line 214 is passed to a first-order low-pass IIR filter 218. The first-order low-pass IIR filter 218 filters the audio signal in dependence on the reflection coefficient for the reflection. The low-pass filter 218 may damp the audio signal, reducing the contribution of high frequencies. In embodiments in which an occlusion coefficient is provided for the reflection, the low-pass filter 218 may filter the audio signal in dependence on both the reflection coefficient and the occlusion coefficient.

The output of the low-pass filter 218 is passed to a gain module 220 which applies an amplitude gain or attenuation in dependence on the reflection coefficient. (In embodiments in which occlusion coefficients are provided for reflections, the gain or attenuation also depends on the occlusion coefficient). The output of the gain module 220 is passed to an HRTF or binaural processing module 222. The HRTF or binaural processing module synthesises binaural sound from the output of the gain module 220. The synthesising of the binaural sound is in dependence on the reflection and occlusion coefficients. In the present embodiment, the method used to synthesise the reflected sound at stage 222 is the same method as is used to synthesise the direct sound at stage 208. In other embodiments, different synthesis methods may be used.

The output of stage 222 is binaural and comprises a left audio output and a right audio output. In alternative embodiments, a different processing method is used, and the audio output may comprise more channels of audio output, for example multiple channels for multiple speakers.

The process described with reference to stages 214 to 222 is repeated for every reflection from the sound source.

For the given sound source, the outputs of stage 208 and of any instances of stage 222 (corresponding to any reflections for the sound source) are combined (for example, added together) to obtain an audio output 224 for the sound source.

The process of FIG. 13 is performed for every sound source. An overall audio output is produced that comprises direct sound and (if applicable) reflected sound for every sound source in the scene. The audio output combines direct sound and reflected sound to provide an audio output that includes the effect of occlusions and reflections on sound from the sound sources.

By providing an audio output that includes the effect of occlusion and reflections, a user may experience the audio output as being more realistic than if occlusions and reflections were not included. As the listener moves around the scene, or as objects move around the scene, occlusions and reflections may change in a way that is familiar to the user as being similar to how the sound would change in real life.

The audio output produced by the method of FIG. 13 may be used in any audio application. For example, the audio output may be used in computer games or applications or in virtual reality or augmented reality. By providing more realistic sound, a user experience may be improved.

The method of FIG. 11 and FIG. 13 may provide a computationally efficient method for calculating occlusions and reflections. In applications such as computer games, the computational resources available for calculating sound may be limited. For example, graphics may be calculated using a dedicated GPU (graphics processing unit) while sound is processed on a general-purpose CPU. Therefore, in some circumstances it may be particularly important that sound is processed efficiently.

In some cases, a synthesis process, for example a binaural synthesis process, may be computationally intensive. The use of an efficient method of calculating occlusions and reflections may allow occlusions and reflections to be added to the synthesis process without an excessive increase in computational load.

The method of calculating occlusions and reflections described above may be used for any appropriate audio system. For example, the method may be used in an audio system proving high-quality reproduction of audio input. The method may be used in virtual reality or augmented reality systems. The method may be used in a computer game. In some circumstances, the method may be used on a device such as a mobile phone. Such a device may have limited computational resources.

A calculation of occlusions or reflections that is based on a full representation of object geometry, for example a calculation using the 3D polygonal mesh geometry for objects, may be complicated and/or CPU intensive. Calculating occlusion and reflections for a full piece of geometry may be a CPU intensive process because of the amount of data involved. Using convex hulls, an object can be represented with fewer data points, making occlusion and reflection calculations much faster. By using convex hulls for calculating occlusions, and using OBBs for calculating reflection, the method used in FIGS. 11 and 13 may be efficient enough to be performed in real time.

A convex hull decomposition that is used to obtain occlusions and reflections may, in some circumstances, not require as much accuracy as a convex hull decomposition that is used for collision detection. The convex hull decomposition method may be computationally efficient.

In the method of FIGS. 11 and 13, occlusions and reflections are automatically processed rather than being analysed individually, for example by a designer. The method of FIGS. 11 and 13 may be used for scenes with large numbers of sources and objects, and for scenes in which there is a lot of movement. Sources, objects and/or the listener may move around the scene.

In the embodiment of FIGS. 11 and 13, occlusion and reflection effects are calculated. In other embodiments, diffraction effects may also be calculated. Diffraction coefficients may be calculated using any appropriate simplified representation of objects, for example using convex hulls and/or oriented bounded boxes. In some embodiments, diffusion may be calculated.

In the present embodiment, real time occlusion and reflection calculations are performed 60 times per second In other embodiment, occlusion and reflection calculations may be performed at any appropriate time interval. Occlusions and reflections may be recalculated in response to movement in the scene.

While certain processes have been described as being performed offline, in other embodiments those processes may be performed in real time. While certain processed have been described as being performed in real time, in other embodiments those processes may be performed offline.

Whilst components of the embodiments described herein (for example, filters) have been implemented in software, it will be understood that any such components can be implemented in hardware, for example in the form of ASICs or FPGAs, or in a combination of hardware and software. Similarly, some or all of the hardware components of embodiments described herein may be implemented in software or in a suitable combination of software and hardware.

It will be understood that the present invention has been described above purely by way of example, and modifications of detail can be made within the scope of the invention. Each feature disclosed in the description, and (where appropriate) the claims and drawings may be provided independently or in any appropriate combination.

The invention claimed is:

1. A method comprising, for a scene comprising a representation of at least one object and at least one sound source:

obtaining a decomposition of the at least one object, the decomposition comprising at least one convex hull, wherein obtaining the decomposition of the at least one object comprises performing a convex hull decomposition of each object, the convex hull decomposition for each object generating the at least one convex hull, the at least one convex hull forming a representation of the object;

modelling at least one interaction of the at least one object and the at least one sound source using the at least one convex hull; and, depending on the modelling of the at least one interaction, processing an audio input associated with the at least one sound source to obtain an audio output.

2. The method according to claim 1, wherein the audio input comprises a monaural audio input, the processing comprises performing binaural synthesis, and the audio output comprises binaural audio output.

3. The method according to claim 1, wherein the representation of the at least one object comprises a polygonal mesh representation of each object.

4. The method according to claim 1, wherein the at least one interaction comprises, for each sound source, at least one occlusion.

5. The method according to claim 4, wherein, for each sound source, modelling the at least one occlusion for that sound source comprises:

obtaining relative positions of the sound source, each convex hull, and a listener position in the scene, the processing performed with respect to the listener position; and determining at least one occlusion coefficient in dependence on the relative positions.

6. The method according to claim 5 wherein, for each sound source, modelling the at least one occlusion comprises determining that one or more of the at least one convex hull is positioned between the sound source and the listener position.

7. The method according to claim 6, wherein determining the at least one occlusion coefficient comprises determining a respective occlusion coefficient for each convex hull that is positioned between the sound source and the listener position.

8. The method according to claim 6, wherein determining that a convex hull is positioned between the sound source and the listener position comprises determining at least one occlusion point at which the convex hull intersects a line between the sound source and the listener position.

9. The method according to claim 8, wherein each occlusion coefficient is dependent on at least one of a number of occlusion points, a spacing of occlusion points.

10. The method according to claim 1, wherein the audio input associated with the at least one sound source comprises, for each sound source, a respective audio signal.

11. The method according to claim 5, wherein the audio input associated with the at least one sound source comprises, for each sound source, a respective audio signal and wherein processing of the audio input comprises, for each audio signal, adjusting in dependence on the at least one occlusion coefficient for the sound source associated with that audio signal at least one of an amplitude or gain of the audio signal, a frequency spectrum of the audio signal.

12. The method according to claim 1, further comprising selecting the at least one object based on a distance between a position associated with each object and a listener position in the scene, the processing performed with respect to the listener position.

13. The method according to claim 12, wherein selecting the at least one object comprises selecting at least one object that is within a threshold distance of the listener position.

14. The method according to claim 1, wherein the at least one interaction comprises, for each sound source, at least one reflection.

15. The method according to claim 14, wherein, for each sound source, modelling each reflection for the sound source comprises determining a reflected ray from the sound source to a listener position in the scene, the processing performed with respect to the listener position.

16. The method according to claim 15, wherein determining a reflected ray comprises determining a reflected ray to the listener position via a face of a convex hull.

17. The method according to claim 16, the method further comprising, for each convex hull, obtaining a further component corresponding to the convex hull.

18. The method according to claim 17, wherein each further component comprises an oriented bounding box.

19. The method according to claim 18, wherein determining a reflected ray from the sound source to the listener position comprises determining a reflected ray from the sound source to the listener position via a face of a further component.

20. The method according to claim 19, wherein determining a reflected ray to the listener position via a face of the further component comprises determining that the face of the further component faces both the sound source and the listener position.

21. The method according to claim 15, wherein the determining of each reflected ray comprises an image-source method, the image-source method comprising creating an image of a sound source by reflecting a position of the sound source in a face of an object.

22. The method according to claim 15, further comprising, for each reflected ray, determining whether the reflected ray is obstructed.

23. The method according to claim 22, further comprising, for any reflected ray that is determined to be obstructed, removing that reflected ray and/or determining an occlusion coefficient for that reflected ray.

24. The method according to claim 14, wherein the processing of the audio input in dependence on the modelling of the at least one interaction comprises processing the audio input in dependence on the determined at least one reflection.

25. The method according to claim 24, wherein the audio input comprises, for each sound source, a respective audio signal.

26. The method according to claim 14, wherein determining the at least one reflection for each sound source comprises determining at least one reflection coefficient for each sound source.

27. The method according to claim 26, wherein processing the audio input comprises, for each audio signal, adjusting in dependence on the at least one reflection coefficient for its associated sound source at least one of an amplitude or gain of the audio signal, a frequency spectrum of the audio signal.

28. The method according to claim 26, wherein processing the audio input comprises applying at least one time delay to each audio signal.

29. The method according to claim 28, wherein applying at least one time delay to each audio signal comprises, for each reflected ray determined for the sound source associated with the audio signal, applying a time delay that is dependent on a length of the reflected ray.

30. An apparatus comprising, for a scene comprising a representation of at least one object and at least one sound source:

means for obtaining a decomposition of the at least one object, the decomposition comprising at least one convex hull, wherein obtaining the decomposition of the at least one object comprises performing a convex hull decomposition of each object, the convex hull decomposition for each object generating the at least one convex hull, the at least one convex hull forming a representation of the object;

means for modelling at least one interaction of the at least one object and the at least one sound source using the at least one convex hull; and means for, depending on the modelling of the at least one interaction, processing an audio input associated with the at least one sound source to obtain an audio output.

31. A non-transitory computer readable storage medium storing instructions thereon, the instructions when executed by a processor cause the processor to:

obtain a decomposition of at least one object, the decomposition comprising at least one convex hull, wherein obtaining the decomposition of the at least one object comprises performing a convex hull decomposition of each object, the convex hull decomposition for each object generating the at least one convex hull, the at least one convex hull forming a representation of the object;

model at least one interaction of the at least one object and at least one sound source using the at least one convex hull; and depend on the modelling of the at least one interaction, processing an audio input associated with the at least one sound source to obtain an audio output.

* * * * *